US011688348B2

(12) United States Patent
Wang et al.

(10) Patent No.: US 11,688,348 B2
(45) Date of Patent: Jun. 27, 2023

(54) PIXEL CIRCUIT AND DRIVING METHOD THEREOF AND DISPLAY PANEL

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventors: Rui Wang, Beijing (CN); Haijun Qiu, Beijing (CN); Fei Shang, Beijing (CN); Ming Hu, Beijing (CN); Shaoru Li, Beijing (CN); Minho Ko, Beijing (CN)

(73) Assignees: CHENGDU BOE OPTOELECTRONICS TECHNOLOGY CO., LTD, Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/763,598

(22) PCT Filed: Apr. 13, 2021

(86) PCT No.: PCT/CN2021/087044

§ 371 (c)(1),
(2) Date: Mar. 24, 2022

(87) PCT Pub. No.: WO2021/238470

PCT Pub. Date: Dec. 2, 2021

(65) Prior Publication Data

US 2022/0343852 A1 Oct. 27, 2022

(30) Foreign Application Priority Data

May 29, 2020 (CN) ..... 202010479787.X

(51) Int. Cl.
*G09G 3/3258* (2016.01)

(52) U.S. Cl.
CPC ... *G09G 3/3258* (2013.01); *G09G 2300/0426* (2013.01); *G09G 2300/0842* (2013.01); *G09G 2310/061* (2013.01)

(58) Field of Classification Search
CPC ..... G09G 3/3258; G09G 3/3233; G09G 2300/0426; G09G 2300/0842;
(Continued)

(56) References Cited

U.S. PATENT DOCUMENTS 10,249,242 B2 * 4/2019 Wu ..... G09G 3/3233
10,373,557 B2 * 8/2019 Zhu ..... G09G 3/3266
(Continued)

FOREIGN PATENT DOCUMENTS

CN 104658484 A 5/2015
CN 106128360 A 11/2016
(Continued)

OTHER PUBLICATIONS

The First Office Action for the Chinese Patent Application No. 202010479787.X issued by the Chinese Patent Office dated Jan. 19, 2021.

(Continued)

*Primary Examiner* — Tom V Sheng
(74) *Attorney, Agent, or Firm* — IP&T Group LLP

(57) ABSTRACT

A pixel circuit includes: a driving sub-circuit including a driving transistor and a storage capacitor; a first reset sub-circuit configured to transmit an initialization signal to a third node under control of at least a first reset signal; a writing sub-circuit configured to transmit the initialization signal to a first node under control of a first scanning signal, and write a data signal received at a data terminal to the first node and perform threshold voltage compensation on the driving transistor under control of the first scanning signal and a second scanning signal; a light-emitting device; and a
(Continued)

light-emitting control sub-circuit configured to, under control of a first enable signal and a second enable signal, transmit a voltage signal of a first voltage terminal to a second node, and transmit a current output by the driving transistor to the light-emitting device.

20 Claims, 34 Drawing Sheets

(58) Field of Classification Search
CPC ..... G09G 2300/0819; G09G 2310/061; G09G 2310/0251; G09G 2320/043; G09G 2320/0233; G09G 2320/045
USPC ..... 345/204
See application file for complete search history.

(56) References Cited

U.S. PATENT DOCUMENTS

| | | | | |
|---|---|---|---|---|
| 10,535,300 | B2 * | 1/2020 | Kim | G09G 3/3233 |
| 10,535,306 | B2 * | 1/2020 | Yang | G09G 3/3266 |
| 10,657,894 | B2 * | 5/2020 | Peng | G09G 3/3233 |
| 10,672,345 | B2 * | 6/2020 | Xiang | G09G 3/3233 |
| 10,796,625 | B2 * | 10/2020 | Zhou | G09G 3/22 |
| 11,244,611 | B2 * | 2/2022 | Yang | G09G 3/3266 |
| 2006/0244688 | A1 | 11/2006 | Ahn et al. | |
| 2014/0111503 | A1 * | 4/2014 | Kwon | G09G 3/3233 345/82 |
| 2016/0140900 | A1 * | 5/2016 | Yang | G09G 3/3258 345/206 |
| 2016/0275854 | A1 | 9/2016 | Wang et al. | |
| 2016/0351121 | A1 * | 12/2016 | Kim | G09G 3/3233 |
| 2017/0124941 | A1 | 5/2017 | Na et al. | |
| 2017/0221418 | A1 * | 8/2017 | Xiang | G09G 3/3233 |
| 2017/0221420 | A1 * | 8/2017 | Zhu | G09G 3/3233 |
| 2017/0249903 | A1 * | 8/2017 | Xiang | G09G 3/3258 |
| 2017/0270853 | A1 * | 9/2017 | Xiang | H01L 27/3276 |
| 2018/0047337 | A1 * | 2/2018 | Zhu | G09G 3/3233 |
| 2018/0197458 | A1 * | 7/2018 | Xi | G09G 3/30 |
| 2018/0308427 | A1 | 10/2018 | Zhang et al. | |
| 2018/0315374 | A1 * | 11/2018 | Zhang | G09G 3/3233 |
| 2019/0266943 | A1 * | 8/2019 | Gao | G09G 3/3233 |
| 2019/0371238 | A1 * | 12/2019 | Gao | G09G 3/3233 |
| 2020/0410926 | A1 * | 12/2020 | Li | G09G 3/3233 |
| 2021/0012713 | A1 * | 1/2021 | Dong | G09G 3/3233 |
| 2021/0118361 | A1 | 4/2021 | Li | |
| 2021/0366362 | A1 * | 11/2021 | Xuan | G09G 3/3233 |
| 2021/0375209 | A1 * | 12/2021 | Han | G09G 3/3258 |
| 2021/0407390 | A1 | 12/2021 | Li et al. | |

FOREIGN PATENT DOCUMENTS

| | | | |
|---|---|---|---|
| CN | 106531076 | A | 3/2017 |
| CN | 106910468 | A | 6/2017 |
| CN | 109087610 | A | 12/2018 |
| CN | 110223636 | A | 9/2019 |
| CN | 111508426 | A | 8/2020 |

OTHER PUBLICATIONS

The Second Office Action for the Chinese Patent Application No. 202010479787.X issued by the Chinese Patent Office dated Jul. 27, 2021.

* cited by examiner

PIXEL CIRCUIT AND DRIVING METHOD THEREOF AND DISPLAY PANEL

CROSS-REFERENCE TO RELATED APPLICATIONS

This application is a national phase entry under 35 USC 371 of International Patent Application No. PCT/CN2021/087044, filed on Apr. 13, 2021, which claims priority to Chinese Patent Application No. 202010479787.X, filed on May 29, 2020, which are incorporated herein by reference in their entirety.

TECHNICAL FIELD

The present disclosure relates to the field of display technologies, and in particular, to a pixel circuit and a driving method thereof, and a display panel.

BACKGROUND

With the development of display technologies, self-luminous display apparatuses such as organic light-emitting diode (OLED) display apparatuses, micro light-emitting diode (micro LED) display apparatuses, and mini light-emitting diode (mini LED) display apparatuses have broad development prospects due to their characteristics such as self-luminous, high contrast, low energy consumption, wide viewing angle, and fast response speed.

SUMMARY

In an aspect, a pixel circuit is provided in some embodiments of the present disclosure. The pixel circuit includes a driving sub-circuit, a first reset sub-circuit, a writing sub-circuit, a light-emitting device and a light-emitting control sub-circuit. The driving sub-circuit includes a driving transistor and a storage capacitor. A gate of the driving transistor is connected to a first node, a first electrode of the driving transistor is connected to a second node, and a second electrode of the driving transistor is connected to a third node. The storage capacitor includes a first storage electrode and a second storage electrode. The first storage electrode is connected to the first node, and the second storage electrode is connected to a first voltage terminal. The first reset sub-circuit is connected to at least the third node, a first reset signal terminal and an initialization signal terminal. The first reset sub-circuit is configured to, in an initialization phase, transmit an initialization signal from the initialization signal terminal to the third node under control of at least a first reset signal received at the first reset signal terminal. The writing sub-circuit is connected to a first scanning terminal, a second scanning terminal, a data terminal, the first node, the second node, and the third node. The writing sub-circuit is configured to: in the initialization phase, transmit the initialization signal at the third node to the first node under control of a first scanning signal received at the first scanning terminal, so as to reset the first node; and in a data writing phase, write a data signal received at the data terminal to the first node and perform threshold voltage compensation on the driving transistor under the control of the first scanning signal received at the first scanning terminal and control of a second scanning signal received at the second scanning terminal. The light-emitting device includes an anode and a cathode, and the cathode being connected to a second voltage terminal. The light-emitting control sub-circuit is connected to the second node, the third node, the first voltage terminal, a first enable signal terminal, a second enable signal terminal, and the anode of the light-emitting device. The light-emitting control sub-circuit is configured to: in a light-emitting phase, under control of a first enable signal received at the first enable signal terminal and control of a second enable signal received at the second enable signal terminal, transmit a voltage signal of the first voltage terminal to the second node, and transmit a current output by the driving transistor to the light-emitting device to make the light-emitting device emit light.

In some embodiments, the pixel circuit further includes a second reset sub-circuit. The second reset sub-circuit is connected to the anode of the light-emitting device, a second reset signal terminal, and the initialization signal terminal. The second reset sub-circuit is configured to, in the initialization phase or the data writing phase, transmit the initialization signal from the initialization signal terminal to the anode of the light-emitting device under control of a second reset signal received at the second reset signal terminal, so as to reset the anode.

In some embodiments, the first reset signal terminal and the second reset signal terminal are connected to a same reset signal terminal.

In some embodiments, the light-emitting control sub-circuit includes a first sub-circuit and a second sub-circuit. The first sub-circuit is connected to the second node, the first voltage terminal, and the first enable signal terminal. The first sub-circuit is configured to, in the light-emitting phase, transmit the voltage signal of the first voltage terminal to the second node under the control of the first enable signal received at the first enable signal terminal. The second sub-circuit is connected to the third node, the second enable signal terminal and the anode of the light-emitting device. The second sub-circuit is configured to, in the light-emitting phase, transmit the current output by the driving transistor to the light-emitting device under the control of the second enable signal received at the second enable signal terminal.

In some embodiments, the first enable signal terminal and the second enable signal terminal are connected to a same enable signal terminal.

In some embodiments, the initialization signal terminal is connected to the anode of the light-emitting device.

In some embodiments, the first reset sub-circuit is used as the second sub-circuit, the initialization signal terminal is connected to the anode of the light-emitting device, and the first reset signal terminal and the second enable signal terminal are connected to a same signal terminal. The signal terminal is configured to transmit the first reset signal in the initialization phase, and transmit the second enable signal in the light-emitting phase.

In some embodiments, the first scanning terminal and the second scanning terminal are connected to a same scanning terminal.

In some embodiments, the writing sub-circuit includes a third sub-circuit and a fourth sub-circuit. The third sub-circuit is connected to the second scanning terminal, the data terminal, and the second node. The third sub-circuit is configured to be turned on at least in the data writing phase under the control of the second scanning signal received at the second scanning terminal, and transmit the data signal received at the data terminal to the second node. The fourth sub-circuit is connected to the first scanning terminal, the first node, and the third node. The fourth sub-circuit is configured to be turned on in the initialization phase and the data writing phase under the control of the first scanning signal received at the first scanning terminal, transmit the initialization signal at the third node to the first node in the initialization phase, and write the data signal at the second node to the first node and perform threshold voltage compensation on the driving transistor in the data writing phase.

In some embodiments, the first reset sub-circuit includes a first transistor, a gate of the first transistor is connected to the first reset signal terminal, a first electrode of the first transistor is connected to the initialization signal terminal, and a second electrode of the first transistor is connected to the third node.

In some embodiments, the second reset sub-circuit includes a second transistor, a gate of the second transistor is connected to the second reset signal terminal, a first electrode of the second transistor is connected to the initialization signal terminal, and a second electrode of the second transistor is connected to the anode of the light-emitting device.

In some embodiments, the first sub-circuit includes a third transistor, a gate of the third transistor is connected to the first enable signal terminal, a first electrode of the third transistor is connected to the first voltage terminal, and a second electrode of the third transistor is connected to the second node. The second sub-circuit includes a fourth transistor, a gate of the fourth transistor is connected to the second enable signal terminal, a first electrode of the fourth transistor is connected to the third node, and a second electrode of the fourth transistor is connected to the anode of the light-emitting device.

In some embodiments, the third sub-circuit includes a fifth transistor, a gate of the fifth transistor is connected to the second scanning terminal, a first electrode of the fifth transistor is connected to the data terminal, and a second electrode of the fifth transistor is connected to the second node.

In some embodiments, the fourth sub-circuit includes a sixth transistor, a gate of the sixth transistor is connected to the first scanning terminal, a first electrode of the sixth transistor is connected to the third node, and a second electrode of the sixth transistor is connected to the first node.

In some embodiments, the fourth sub-circuit includes a seventh transistor and an eighth transistor. A gate of the seventh transistor is connected to the first scanning terminal, a first electrode of the seventh transistor is connected to the third node, and a second electrode of the seventh transistor is connected to a fourth node. A gate of the eighth transistor is connected to the first scanning terminal, a first electrode of the eighth transistor is connected to the fourth node, and a second electrode of the eighth transistor is connected to the first node.

In some embodiments, the first reset sub-circuit includes a ninth transistor and the seventh transistor. A gate of the ninth transistor is connected to the first reset signal terminal, a first electrode of the ninth transistor is connected to the initialization signal terminal, and a second electrode of the ninth transistor is connected to the fourth node.

In another aspect, a display panel is provided in embodiments of the present disclosure. The display panel includes the above pixel circuit.

In some embodiments, the display panel has a plurality of sub-pixel regions arranged in an array, and each sub-pixel region is provided with the pixel circuit. The display panel further includes a plurality of scanning lines, and first scanning terminals and second scanning terminals to which pixel circuits located in a same row are connected are connected to a scanning line. Alternatively, the display panel further includes a plurality of first scanning lines and a plurality of second scanning lines, and first scanning terminals and second scanning terminals to which pixel circuits located in a same row are connected are respectively connected to a first scanning line and a second scanning line.

In some embodiments, the first scanning terminals and the second scanning terminals to which the pixel circuits located in the same row are connected are connected to the scanning line, and first reset signal terminals to which pixel circuits located in an nth row are connected are connected to a scanning line that is connected to pixel circuits located in an (n−1)th row.

In yet another aspect, a driving method of the pixel circuit is provided in embodiments of the present disclosure. The driving method includes: in an initialization phase of an image frame, inputting the first reset signal to the first reset signal terminal, so that the first reset sub-circuit transmits the initialization signal from the initialization signal terminal to the third node; and inputting the first scanning signal to the first scanning terminal, so that the writing sub-circuit transmits the initialization signal at the third node to the first node to reset the first node; in a data writing phase of the image frame, inputting the first scanning signal to the first scanning terminal, inputting the second scanning signal to the second scanning terminal, and inputting the data signal to the data terminal, so that the writing sub-circuit writes the data signal received at the data terminal into the first node, and performs the threshold voltage compensation on the driving transistor; and in a light-emitting phase of the image frame, inputting the first enable signal to the first enable signal terminal, and inputting the second enable signal to the second enable signal terminal, so that the light-emitting control sub-circuit transmits the voltage signal of the first voltage terminal to the second node, and transmits the current output by the driving transistor to the light-emitting device to make the light-emitting device emit light.

In some embodiments, the driving method further includes in the initialization phase of the image frame, inputting the data signal to the data terminal.

BRIEF DESCRIPTION OF THE DRAWINGS

In order to describe technical solutions in the present disclosure more clearly, accompanying drawings to be used in some embodiments of the present disclosure will be introduced briefly below. However, the accompanying drawings to be described below are merely accompanying drawings of some embodiments of the present disclosure, and a person of ordinary skill in the art can obtain other drawings according to these drawings. In addition, the accompanying drawings to be described below may be regarded as schematic diagrams, but are not limitations on actual sizes of products, actual processes of methods and actual timings of signals involved in the embodiments of the present disclosure.

DETAILED DESCRIPTION

Technical solutions in some embodiments of the present disclosure will be described clearly and completely below with reference to the accompanying drawings. However, the described embodiments are merely some but not all embodiments of the present disclosure. All other embodiments obtained by a person of ordinary skill in the art based on the embodiments of the present disclosure shall be included in the protection scope of the present disclosure.

Unless the context requires otherwise, throughout the description and the claims, the term "comprise" and other forms thereof such as the third-person singular form "comprises" and the present participle form "comprising" are construed as an open and inclusive meaning, i.e., "including, but not limited to". In the description of the specification, the terms such as "one embodiment", "some embodiments", "exemplary embodiments", "example", "specific example" or "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or examples(s). In addition, the specific features, structures, materials, or characteristics may be included in any one or more embodiments or examples in any suitable manner.

Hereinafter, the terms such as "first" and "second" are used for descriptive purposes only, and are not to be construed as indicating or implying the relative importance or implicitly indicating the number of indicated technical features. Thus, a feature defined with "first" or "second" may explicitly or implicitly include one or more of the features. In the description of the embodiments of the present disclosure, the term "a plurality of/the plurality of" means two or more unless otherwise specified.

In the description of some embodiments, the term "connected" may be used. For example, the term "connected" may be used in the description of some embodiments to indicate that two or more components are in direct physical contact or electrical contact with each other.

Figure 1A:
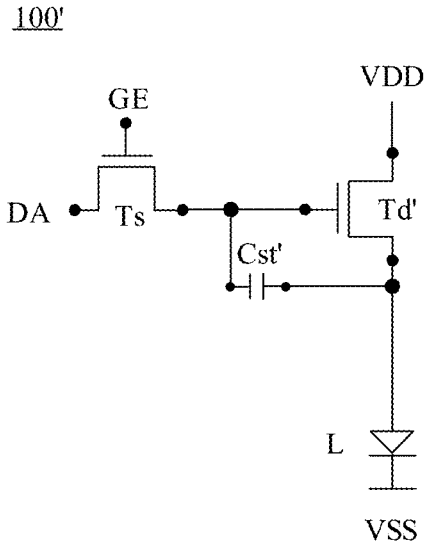
FIG. 1A is a structural diagram of a driving circuit provided in the related art.

Light-emitting diodes (e.g., organic light-emitting diodes) are current-driven type devices. FIG. 1A shows a driving circuit 100' for driving a light-emitting diode L in the related art, and the driving circuit 100' is composed of a driving transistor Td', a switching transistor Ts and a storage capacitor Cst'. When the driving circuit 100' drives the light-emitting diode L to emit light, a gate of the switching transistor Ts receives a scanning signal from a scanning signal terminal GE, so that the switching transistor Ts is turned on. A data signal of a data signal terminal DA is transmitted to a gate of the driving transistor Td' through the switching transistor Ts, and the driving transistor Td' is turned on, which makes a first voltage terminal VDD, the light-emitting diode L, and a second voltage terminal VSS communicate, so that a driving current generated by the driving transistor Td' drives the light-emitting diode L to emit light. In this process, the data signal of the data signal terminal DA charges the storage capacitor Cst' connected to the turned-on switching transistor Ts, and electric energy stored in the storage capacitor Cst' keeps the driving transistor Td' turned on for time required for displaying an image frame.

A formula of a saturation current of a driving transistor is:

$$I=K(Vgs-Vth)^2 \quad (1)$$

Here, K is a coefficient related to characteristics of the driving transistor, Vgs is a gate-source voltage of the driving transistor, and Vth is a threshold voltage of the driving transistor.

In a display apparatus, the display apparatus usually includes a plurality of light-emitting diodes L, and correspondingly, there are a plurality of driving circuits for driving the plurality of light-emitting diodes L to emit light. Due to difference in process, temperature, device aging, etc., a threshold voltage Vth of the driving transistor Td' may drift, which causes the driving current provided by the driving transistor Td' to the light-emitting diode L to deviate from a target current value. Since threshold voltages Vth of driving transistors Td' in different driving circuits may be different, brightness of the light-emitting diodes L may be different, which causes non-uniform display of the display apparatus.

Figure 1B:
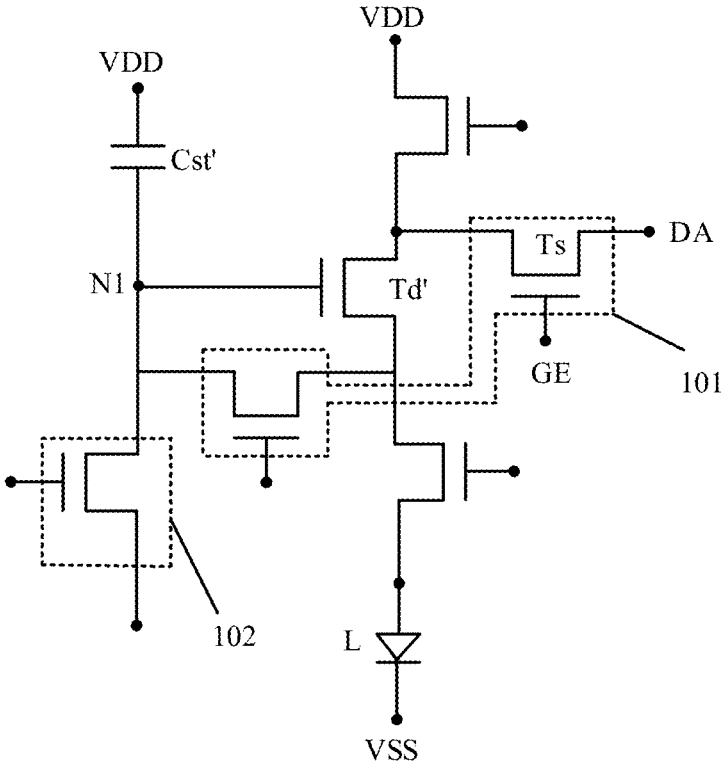
FIG. 1B is a structural diagram of another driving circuit provided in the related art.
Figure 1C:
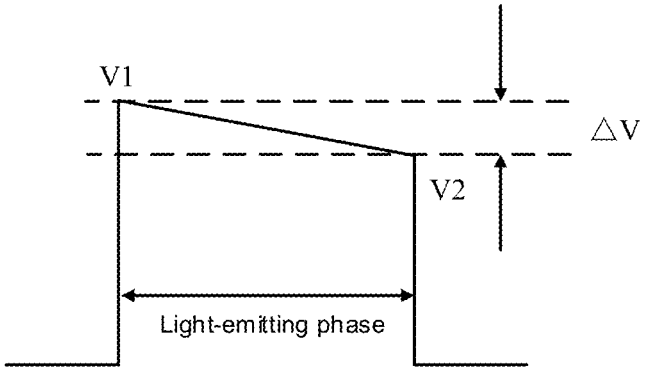
FIG. 1C is a schematic diagram showing a change in a voltage of a gate of a driving transistor in a driving circuit provided in the related art.

In order to improve effect of the drift of the threshold voltage Vth of the driving transistor Td', as shown in FIG. 1B, a threshold voltage compensation sub-circuit 101 is added to the driving circuit shown in FIG. 1A, so as to compensate the threshold voltage Vth of the driving transistor Td' before the driving circuit drives the light-emitting diode L to emit light, thereby eliminating effect of the drift of the threshold voltage Vth on the display apparatus.

In addition, after an image frame is displayed and before a next image frame is displayed, there may be a residual voltage at the gate of the driving transistor Td'. In order to eliminate an effect of the residual voltage of the image frame on the next image frame, as shown in FIG. 1B, the driving circuit further includes a reset sub-circuit 102 to reset the gate of the driving transistor Td' before the next image frame is displayed.

In the related art, as shown in FIG. 1B, the threshold voltage compensation sub-circuit 101 and the reset sub-circuit 102 are electrically connected to a first node N1 (i.e., the gate of the driving transistor Td'), resulting in a voltage of the first node N1 being affected by transistors in the threshold voltage compensation sub-circuit 101 and the reset sub-circuit 102. The threshold voltage compensation sub-circuit 101 and the reset sub-circuit 102 each include at least one transistor, and a transistor has a leakage current, which affects the voltage of the first node N1, resulting in a change in the gate-source voltage of the driving transistor Td'. It can be seen from the formula (1) that, the driving current may change due to the change in the gate-source voltage of the driving transistor Td', which causes a change in brightness of the light-emitting diode L, resulting in flicker phenomenon in an image displayed on the display apparatus.

In the related art, test results of the flicker phenomenon are shown in Table 1.

TABLE 1

| Display apparatus | Driving frequency (Hz) | | | | | | |
|---|---|---|---|---|---|---|---|
| | 60 | 50 | 40 | 30 | 20 | 15 | 7.5 |
| | Flicker phenomenon | | | | | | |
| M1 | None | None | Yes (L1) | Yes (L2) | Yes (L3) | Yes (abnormal scrolling display) | Yes (severe abnormal scrolling display) |
| M2 | None | None | Yes (L1) | Yes (L2) | Yes (L3) | Yes (abnormal scrolling display) | Yes (severe abnormal scrolling display) |

As shown in Table 1, in a case where display apparatuses are driven at a low driving frequency (e.g., less than 40 Hz), both the display apparatus M1 and the display apparatus M2 have the flicker phenomenon. As the driving frequency decreases, the flicker phenomenon becomes more serious. For example, when the driving frequency is 40 Hz, the flicker phenomenon is at level one (L1), and when the driving frequency is 20 Hz, the flicker phenomenon is at level three (L3); when the driving frequency is 15 Hz, the display apparatuses display abnormal scrolling, and when the driving frequency is 7.5 Hz, the display apparatuses display serious abnormal scrolling.

Figure 10:
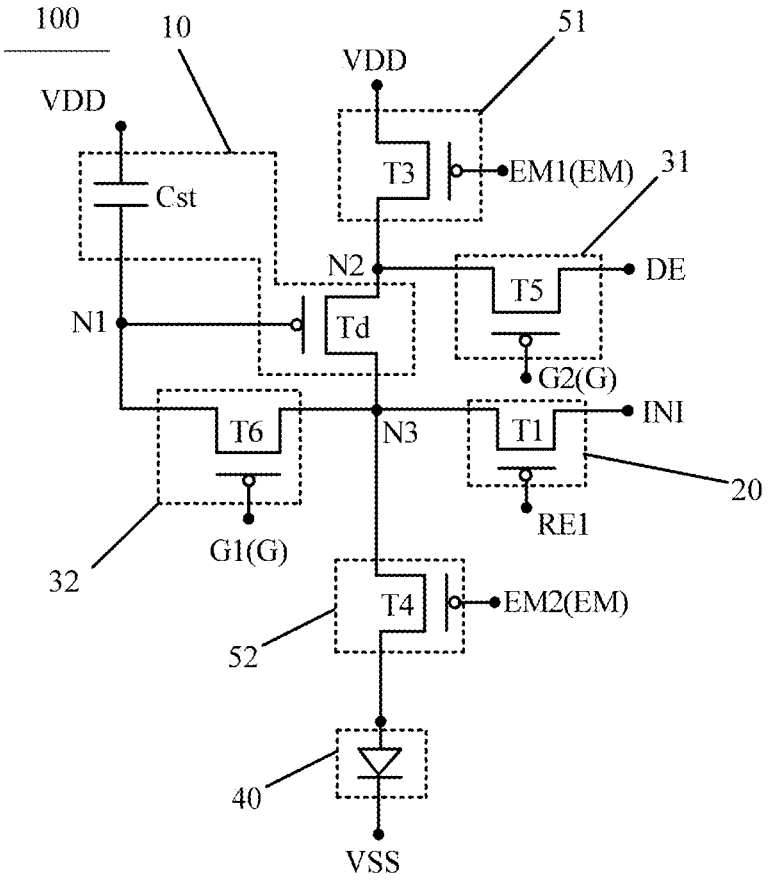
FIG. 10 is a diagram showing a structure of another pixel circuit provided in embodiments of the present disclosure.

A reason for the flicker phenomenon is as the follows. As shown in FIG. 10, the voltage of the first node N1 is V1 at a start of a light-emitting phase; during the light-emitting phase, the transistors in the threshold voltage compensation sub-circuit 101 and the reset sub-circuit 102 are in an off state; and due to leakage currents of the transistors, the voltage of the first node N1 continuously changes in the light-emitting phase. The voltage on the first node N1 is V2 at an end of the light-emitting phase; and during the light-emitting phase, a change amount of the voltage of the first node N1 is ΔV. The smaller the driving frequency, the longer the time of an image frame. The larger the ΔV, the more serious the change in the brightness of the light-emitting diode LED, and thus the more serious the flicker phenomenon.

Figure 2:
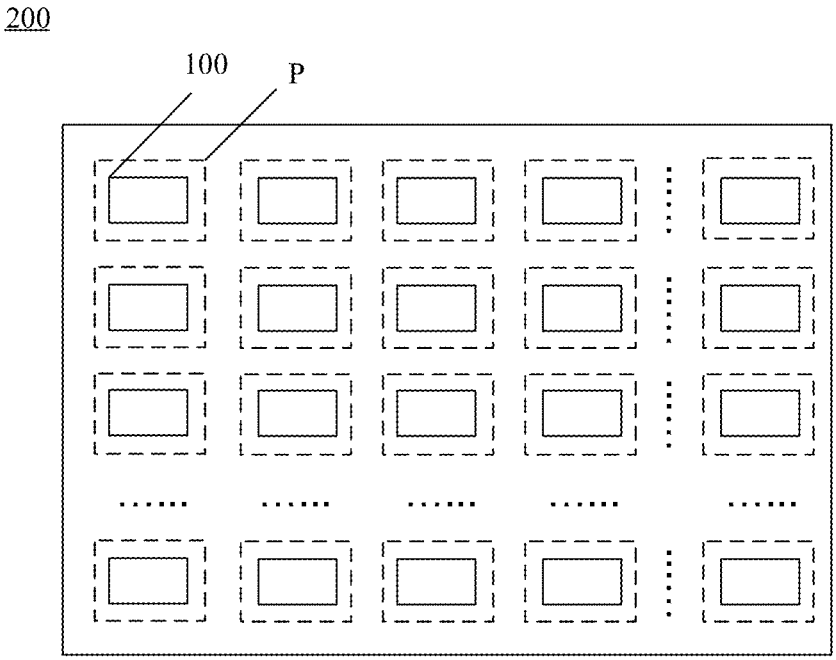
FIG. 2 is a top view showing a structure of a display panel provided in embodiments of the present disclosure.

Some embodiments of the present disclosure provide a display panel. As shown in FIG. 2, the display panel 200 includes a plurality of pixel circuits 100.

In some embodiments, as shown in FIG. 2, the display panel 200 has a plurality of sub-pixel regions P arranged in an array, and each sub-pixel region P is provided with a pixel circuit 100.

Figure 3A:
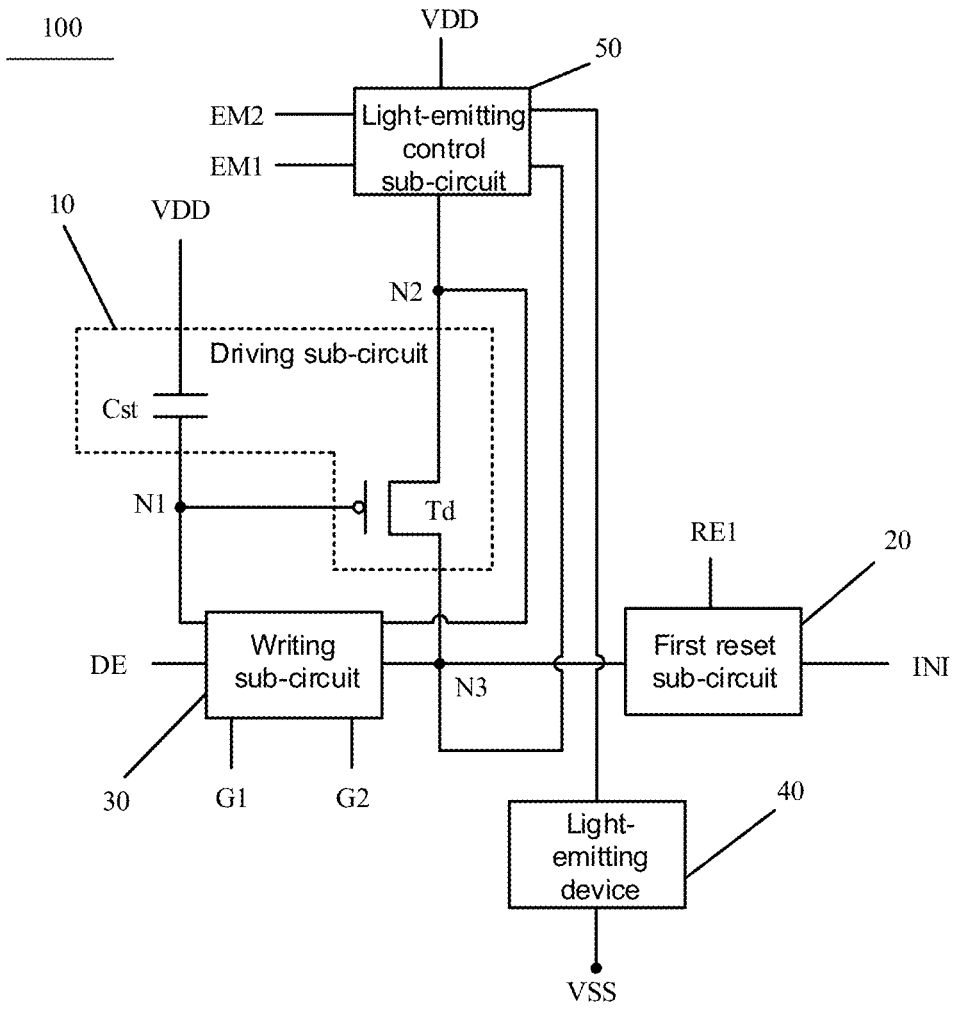
FIG. 3A is a structural diagram of a pixel circuit provided in embodiments of the present disclosure.

As shown in FIG. 3A, the pixel circuit 100 provided in some embodiments of the present disclosure includes: a driving sub-circuit 10, a first reset sub-circuit 20, a writing sub-circuit 30, a light-emitting device 40 and a light-emitting control sub-circuit 50.

The driving sub-circuit 10 includes a driving transistor Td and a storage capacitor Cst. A gate of the driving transistor Td is connected to a first node N1, a first electrode of the driving transistor Td is connected to a second node N2, and a second electrode of the driving transistor Td is connected to a third node N3. The storage capacitor Cst includes a first storage electrode and a second storage electrode, the first storage electrode is connected to the first node N1, and the second storage electrode is connected to a first voltage terminal VDD.

The driving transistor Td is a transistor that supplies a current to the light-emitting device 40. A width-to-length ratio of the driving transistor Td is greater than a width-to-length ratio of a transistor for switching.

The first reset sub-circuit 20 is connected to at least the third node N3, a first reset signal terminal RE1 and an initialization signal terminal INI. The first reset signal terminal RE1 is configured to receive a first reset signal and transmit the first reset signal to the first reset sub-circuit 20. The initialization signal terminal INI is configured to receive an initialization signal and transmit the initialization signal to the first reset sub-circuit 20.

The first reset sub-circuit 20 is configured to, in an initialization phase, transmit the initialization signal from the initialization signal terminal INI to the third node N3 under control of at least the first reset signal received at the first reset signal terminal RE1.

The writing sub-circuit 30 is connected to a first scanning terminal G1, a second scanning terminal G2, a data terminal DE, the first node N1, the second node N2 and the third node N3. The first scanning terminal G1 is configured to receive a first scanning signal and transmit the first scanning signal to the writing sub-circuit 30. The second scanning terminal G2 is configured to receive a second scanning signal and transmit the second scanning signal to the writing sub-circuit 30. The data terminal DE is configured to receive a data signal and transmit the data signal to the writing sub-circuit 30.

The writing sub-circuit 30 is configured to: in the initialization phase, under control of the first scanning signal received at the first scanning terminal G1, transmit the initialization signal at the third node N3 to the first node N1, so as to reset the first node N1; and in a data writing phase, under the control of the first scanning signal received at the first scanning terminal G1 and control of the second scanning signal received at the second scanning terminal G2, write the data signal received at the data terminal DE into the first node N1 and perform threshold voltage compensation on the driving transistor Td.

The light-emitting device 40 includes an anode and a cathode, and the cathode is connected to a second voltage terminal VSS. For example, the light-emitting device 40 is an organic light-emitting diode (OLED), a micro light-emitting diode (micro LED), or a mini light-emitting diode (mini LED).

The light-emitting control sub-circuit 50 is connected to the second node N2, the third node N3, the first voltage terminal VDD, a first enable signal terminal EM1, a second enable signal terminal EM2, and the anode of the light-emitting device 40. The first voltage terminal VDD is configured to receive a voltage signal and transmit the voltage signal to the light-emitting control sub-circuit 50. The first enable signal terminal EM1 is configured to receive a first enable signal and transmit the first enable signal to the light-emitting control sub-circuit 50. The second enable signal terminal EM2 is configured to receive a second enable signal and transmit the second enable signal to the light-emitting control sub-circuit 50. Here, the voltage signal of the first voltage terminal VDD is a high-level signal, and a voltage signal of the second voltage terminal VSS is a low-level signal.

The light-emitting control sub-circuit 50 is configured to: in the light-emitting phase, under control of the first enable signal received at the first enable signal terminal EM1 and control of the second enable signal received at the second enable signal terminal EM2, transmit the voltage signal of the first voltage terminal VDD to the second node N2, and transmit a current output by the driving transistor Td to the light-emitting device 40, so that the light-emitting device 40 emits light.

In the pixel circuit 100 provided in some embodiments of the present disclosure, the writing sub-circuit 30 is connected to the first node N1 (i.e., the gate of the driving transistor Td), and the first reset sub-circuit 20 is connected to the third node N3. Compared with the driving circuit 100' in the related art, in the embodiments of the present disclosure, only the writing sub-circuit 30 is directly connected to the gate of the driving transistor Td. In this way, an effect on a voltage of the gate of the driving transistor Td is small, and in the light-emitting phase, a change amount ΔV of the voltage of the gate of the driving transistor Td is reduced, so that the effect on a light-emitting performance of the light-emitting device 40 is reduced. As a result, a light-emitting performance of the display panel may be improved, and probability of the flicker phenomenon is reduced.

Figure 3B:
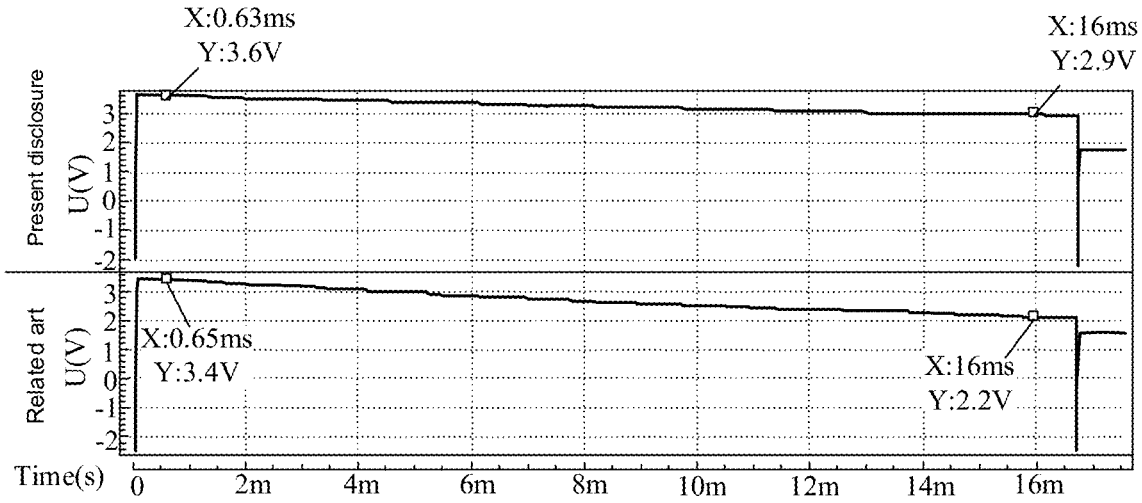
FIG. 3B is a diagram showing a simulation result of voltages of a gate of a driving transistor in a pixel circuit provided in embodiments of the present disclosure and a gate of a driving transistor in a driving circuit provided in the related art.

FIG. 3B is a diagram showing a simulation result, in one image frame, of voltages of the gate of the driving transistor Td in the pixel circuit 100 provided in the embodiments of the present disclosure and the gate of the driving transistor Td' in the driving circuit 100' provided in the related art. As shown in FIG. 3B, in the light-emitting phase, the voltage of the gate of the driving transistor Td' in the driving circuit 100' provided in the related art changes from 3.4 V to 2.2 V, and the change amount ΔV of the voltage thereof is 1.2 V. The voltage of the gate of the driving transistor Td in the pixel circuit 100 provided in the embodiments of the present disclosure changes from 3.6 V to 2.9 V, and the change amount ΔV of the voltage thereof is 0.7 V. Therefore, the pixel circuit 100 provided in the embodiments of the present disclosure can effectively maintain the voltage of the gate of the driving transistor Td, which is conducive to improving the flicker phenomenon.

Figure 4:
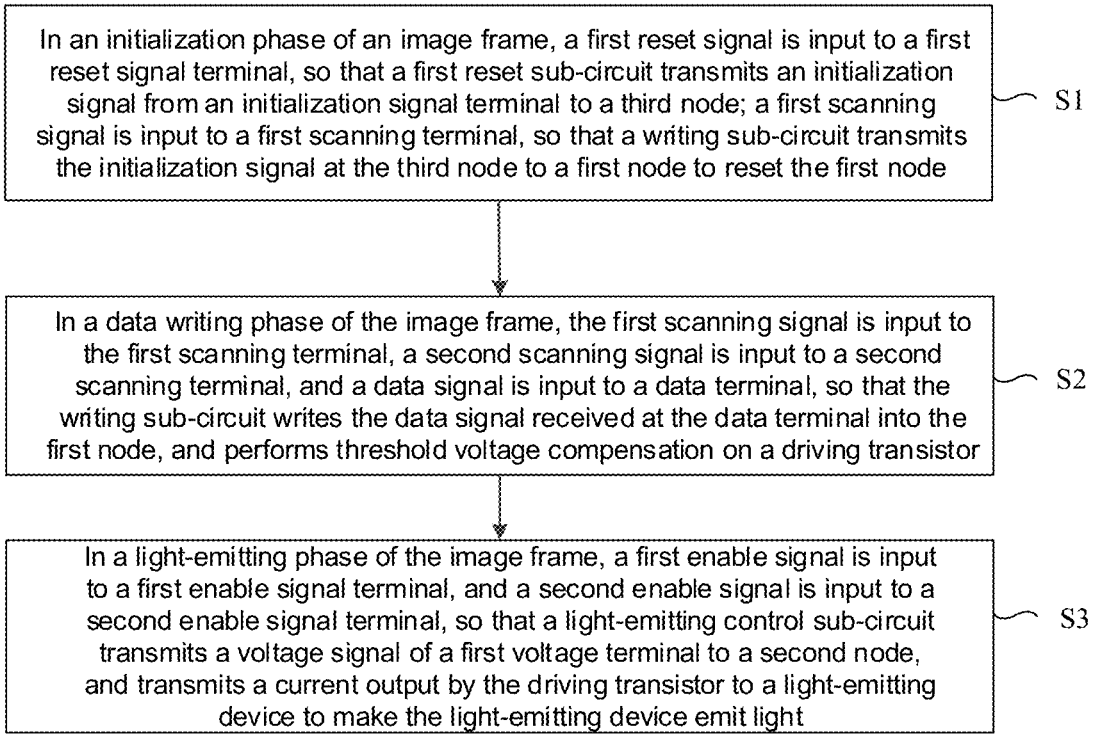
FIG. 4 is a flow diagram of a driving method of a pixel circuit provided in embodiments of the present disclosure.

Some embodiments of the present disclosure provide a driving method of the pixel circuit 100. As shown in FIG. 4, the driving method includes steps 1 to 3 (S1 to S3).

In S1, in an initialization phase of an image frame, the first reset signal is input to the first reset signal terminal RE1, so that the first reset sub-circuit 20 transmits the initialization signal from the initialization signal terminal INI to the third node N3; and the first scanning signal is input to the first scanning terminal G1, so that the writing sub-circuit 30 transmits the initialization signal at the third node N3 to the first node N1 to reset the first node N1.

In S2, in a data writing phase of the image frame, the first scanning signal is input to the first scanning terminal G1, the second scanning signal is input to the second scanning terminal G2, and the data signal is input to the data terminal DE, so that the writing sub-circuit 30 writes the data signal received at the data terminal DE into the first node N1, and performs the threshold voltage compensation on the driving transistor Td.

In S3, in a light-emitting phase of the image frame, the first enable signal is input to the first enable signal terminal EM1, and the second enable signal is input to the second enable signal terminal EM2, so that the light-emitting control sub-circuit 50 transmits the voltage signal of the first voltage terminal VDD to the second node N2, and transmits the current output by the driving transistor Td to the light-emitting device 40 to cause the light-emitting device 40 to emit light.

In some embodiments, the driving method of the pixel circuit 100 further includes: in the initialization phase of the image frame, inputting the data signal to the data terminal DE for precharging. Thus, it is conducive to writing the data signal.

Figure 5:
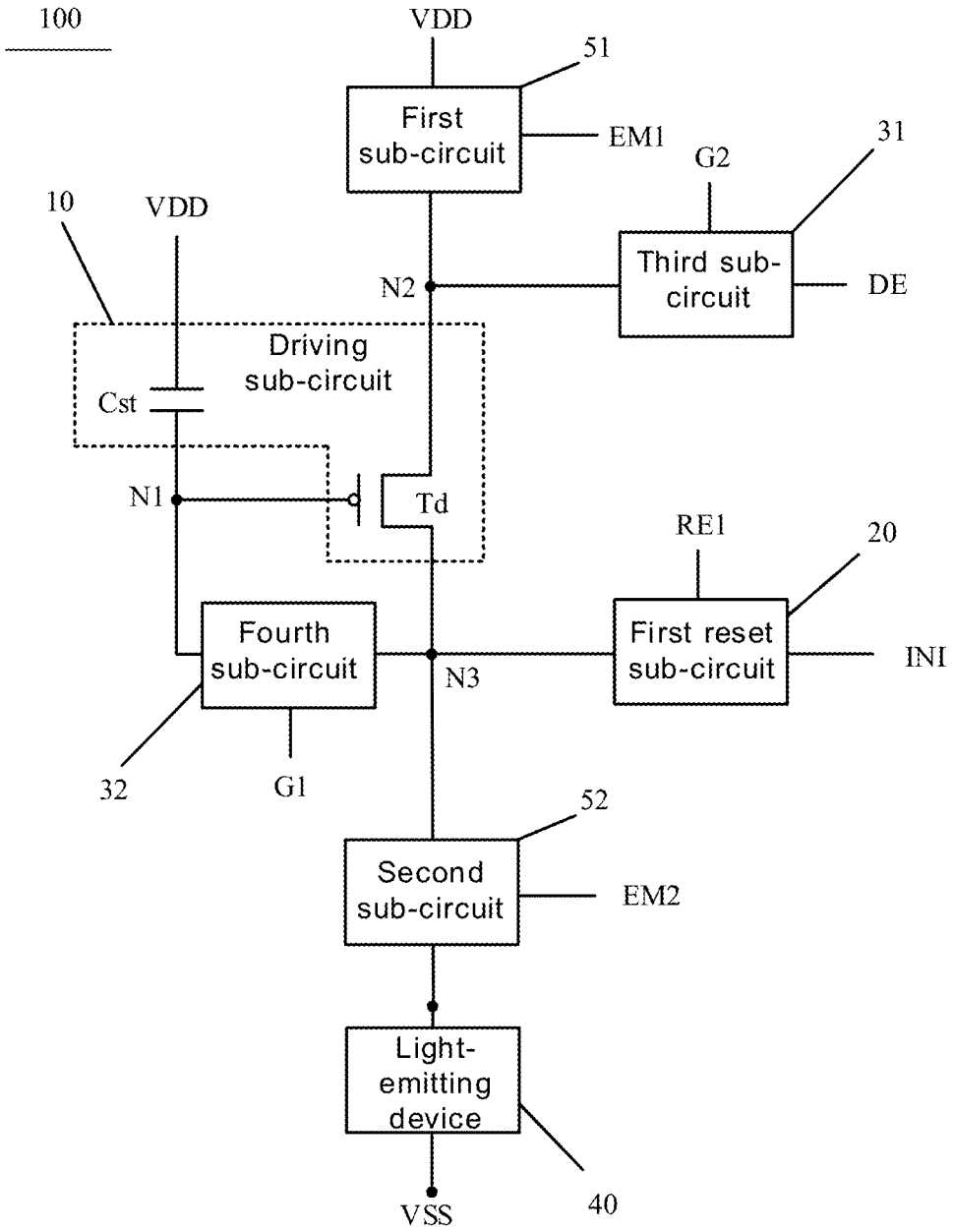
FIG. 5 is a structural diagram of another pixel circuit provided in embodiments of the present disclosure.

In some embodiments, as shown in FIG. 5, the light-emitting control sub-circuit 50 includes a first sub-circuit 51 and a second sub-circuit 52.

The first sub-circuit 51 is connected to the second node N2, the first voltage terminal VDD and the first enable signal terminal EM1.

The first sub-circuit 51 is configured to: in the light-emitting phase, transmit the voltage signal of the first voltage terminal VDD to the second node N2 under the control of the first enable signal of the first enable signal terminal EM1.

The second sub-circuit 52 is connected to the third node N3, the second enable signal terminal EM2 and the anode of the light-emitting device 40.

The second sub-circuit 52 is configured to: in the light-emitting phase, transmit the current output by the driving transistor Td to the light-emitting device 40 under the control of the second enable signal of the second enable signal terminal EM2.

In some embodiments, as shown in FIG. 5, the writing sub-circuit 30 includes a third sub-circuit 31 and a fourth sub-circuit 32.

The third sub-circuit 31 is connected to the second scanning terminal G2, the data terminal DE and the second node N2.

The third sub-circuit 31 is configured to be turned on at least in the data writing phase under the control of the second scanning signal of the second scanning terminal G2, and transmit the data signal received at the data terminal DE to the second node N2.

The fourth sub-circuit 32 is connected to the first scanning terminal G1, the first node N1 and the third node N3.

The fourth sub-circuit 32 is configured to be turned on in the initialization phase and the data writing phase under the control of the first scanning signal received at the first scanning terminal G1, transmit the initialization signal at the third node N3 to the first node N1 in the initialization phase, and write the data signal at the second node N2 into the first node N1 and perform the threshold voltage compensation on the driving transistor Td in the data writing phase.

Sub-pixel regions P of the display panel 200 that are arranged in a two by two (2×2) array are taken as an example. In some embodiments, as shown in FIG. 6A, the display panel 200 further includes a plurality of first scanning lines GL1, a plurality of second scanning lines GL2, a plurality of first enable signal lines EML1, a plurality of second enable signal lines EML2, and a plurality of first reset signal lines RL1.

First scanning terminals G1 and second scanning terminals G2 to which all pixel circuits 100 located in a same row are connected are respectively connected to a first scanning line GL1 and a second scanning line GL2. First reset signal terminals RE1 to which all the pixel circuits 100 located in the same row are connected are connected to a same first reset signal line RL1. First enable signal terminals EM1 to which all the pixel circuits 100 located in the same row are connected are connected to a same first enable signal line EML1. Second enable signal terminals EM2 to which all the pixel circuits 100 located in the same row are connected are connected to a same second enable signal line EML2.

The first scanning line GL1 is configured to provide the first scanning signal to the first scanning terminals G1 to which a row of pixel circuits 100 are connected. The second scanning line GL2 is configured to provide the second scanning signal to the second scanning terminals G2 to which a row of pixel circuits 100 are connected. The first reset signal line RL1 is configured to provide the first reset signal to the first reset signal terminals RE1 to which a row of pixel circuits 100 are connected. The first enable signal line EML1 is configured to provide the first enable signal to the first enable signal terminals EM1 to which a row of pixel circuits 100 are connected. The second enable signal line EML2 is configured to provide the second enable signal to the second enable signal terminals EM2 to which a row of pixel circuits 100 are connected.

Figure 6A:
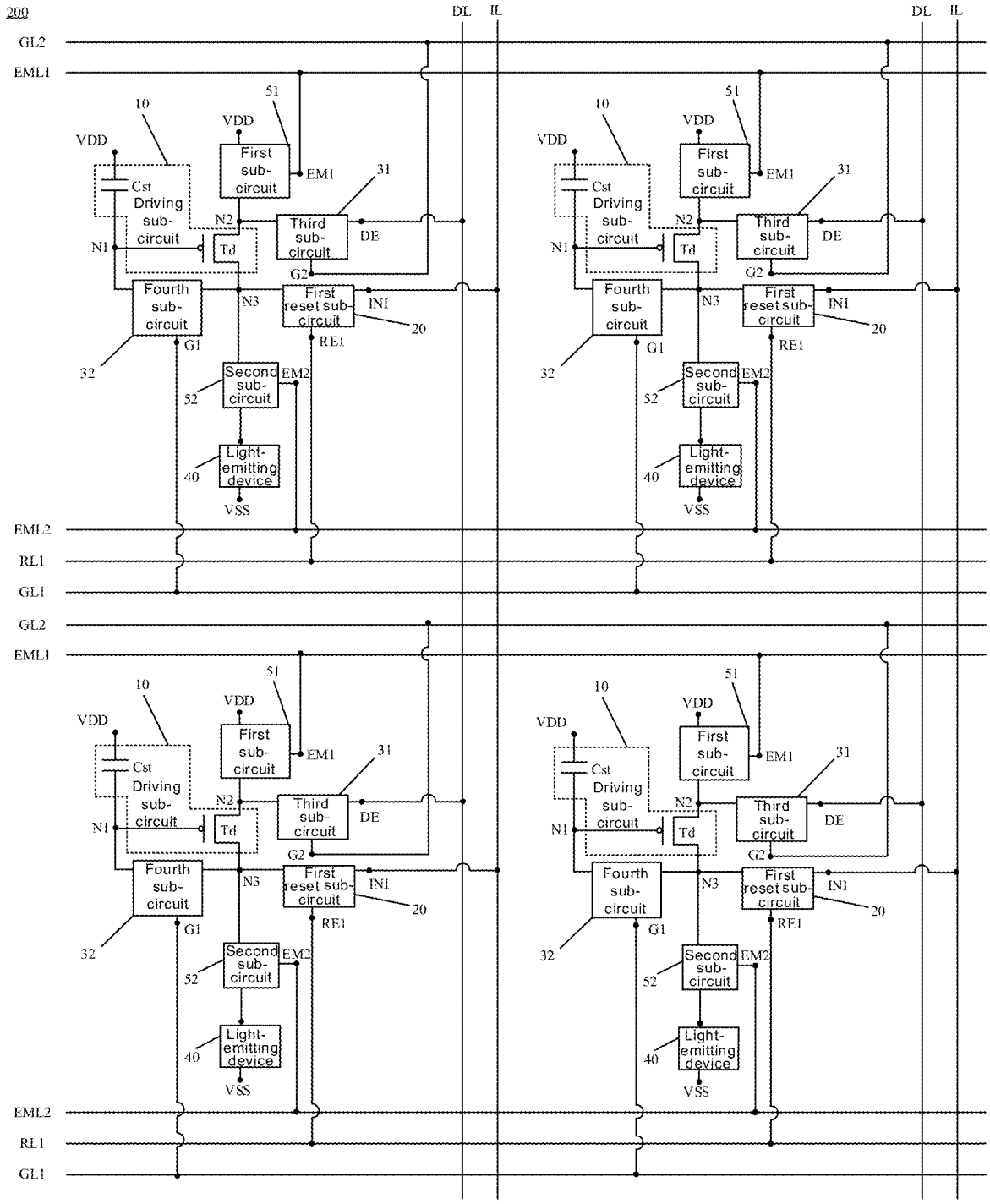
FIG. 6A is a diagram showing connections of circuits in a display panel provided in embodiments of the present disclosure.

As shown in FIG. 6A, the display panel 200 further includes a plurality of data signal lines DL and a plurality of initialization signal lines IL.

In some embodiments, data terminals DE to which all pixel circuits 100 located in a same column are connected are connected to a same data signal line DL. Initialization signal terminals INI to which all the pixel circuits 100 located in the same column are connected are connected to a same initialization signal line IL.

The data signal line DL is configured to provide the data signal to the data terminals DE to which the column of pixel circuits 100 are connected. The initialization signal line IL is configured to provide the initialization signal to the initialization signal terminals INI to which the column of pixel circuits 100 are connected.

In some embodiments, the first scanning terminal G1 and the second scanning terminal G2 are connected to a same scanning terminal. In the case where the first scanning terminal G1 and the second scanning terminal G2 are connected to the same scanning terminal, the first scanning signal and the second scanning signal are a same scanning signal.

Figure 6B:
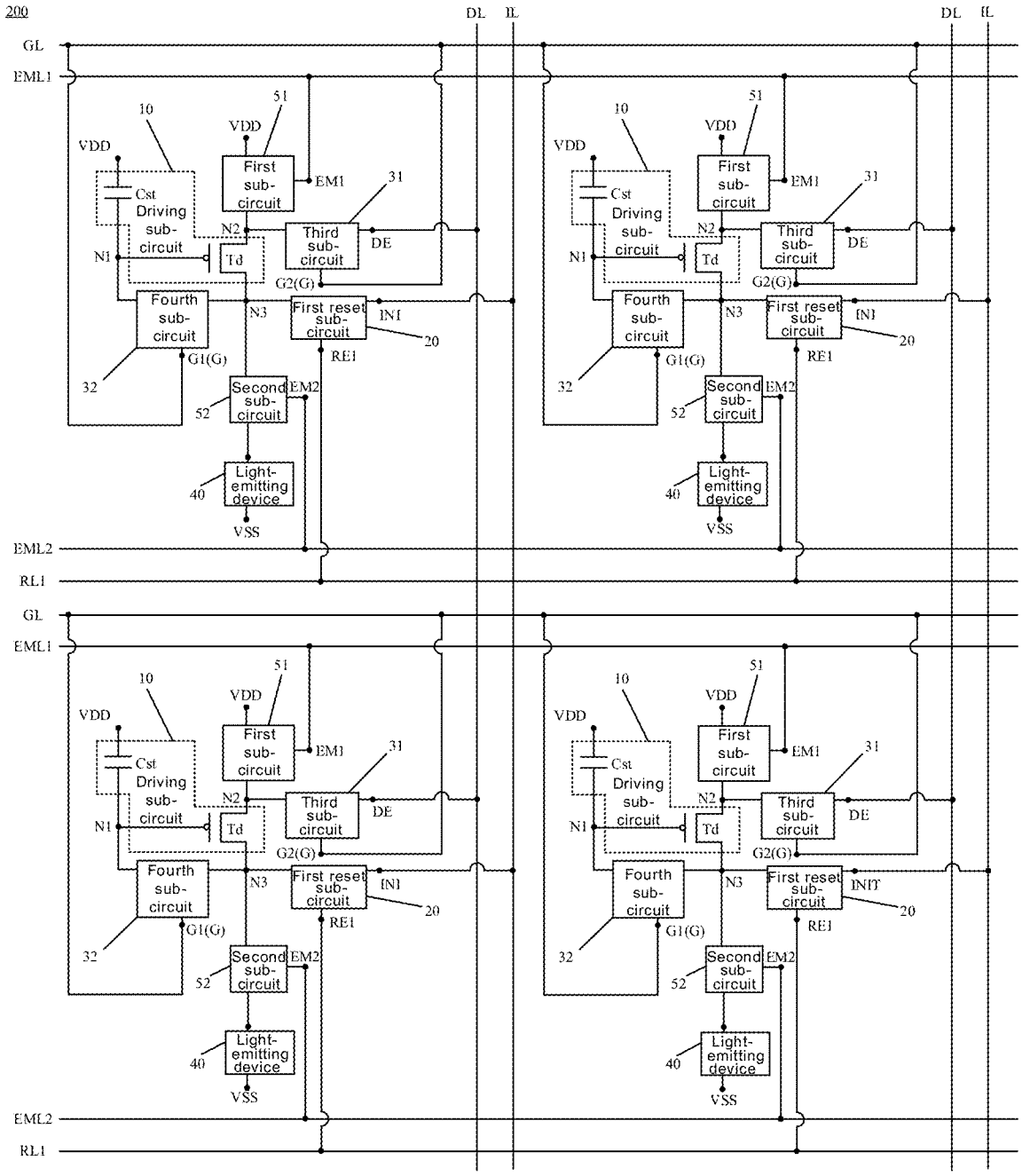
FIG. 6B is a diagram showing connections of circuits in another display panel provided in embodiments of the present disclosure.

For example, as shown in FIG. 6B, the display panel 200 includes a plurality of scanning lines GL, and first scanning terminals G1 and second scanning terminals G2 to which all pixel circuits 100 located in a same row are connected are connected to a scanning line GL. That is, the scanning terminals G to which all the pixel circuits 100 located in the same row are connected are connected to one scanning line GL.

In this case, the third sub-circuit 31 is configured to be turned on in the initialization phase and the data writing phase under the control of the second scanning signal of the second scanning terminal G2.

In some embodiments, the first enable signal terminal EM1 and the second enable signal terminal EM2 are connected to a same enable signal terminal. In the case where the first enable signal terminal EM1 and the second enable signal terminal EM2 are connected to the same enable signal terminal, the first enable signal and the second enable signal are a same enable signal.

Figure 6C:
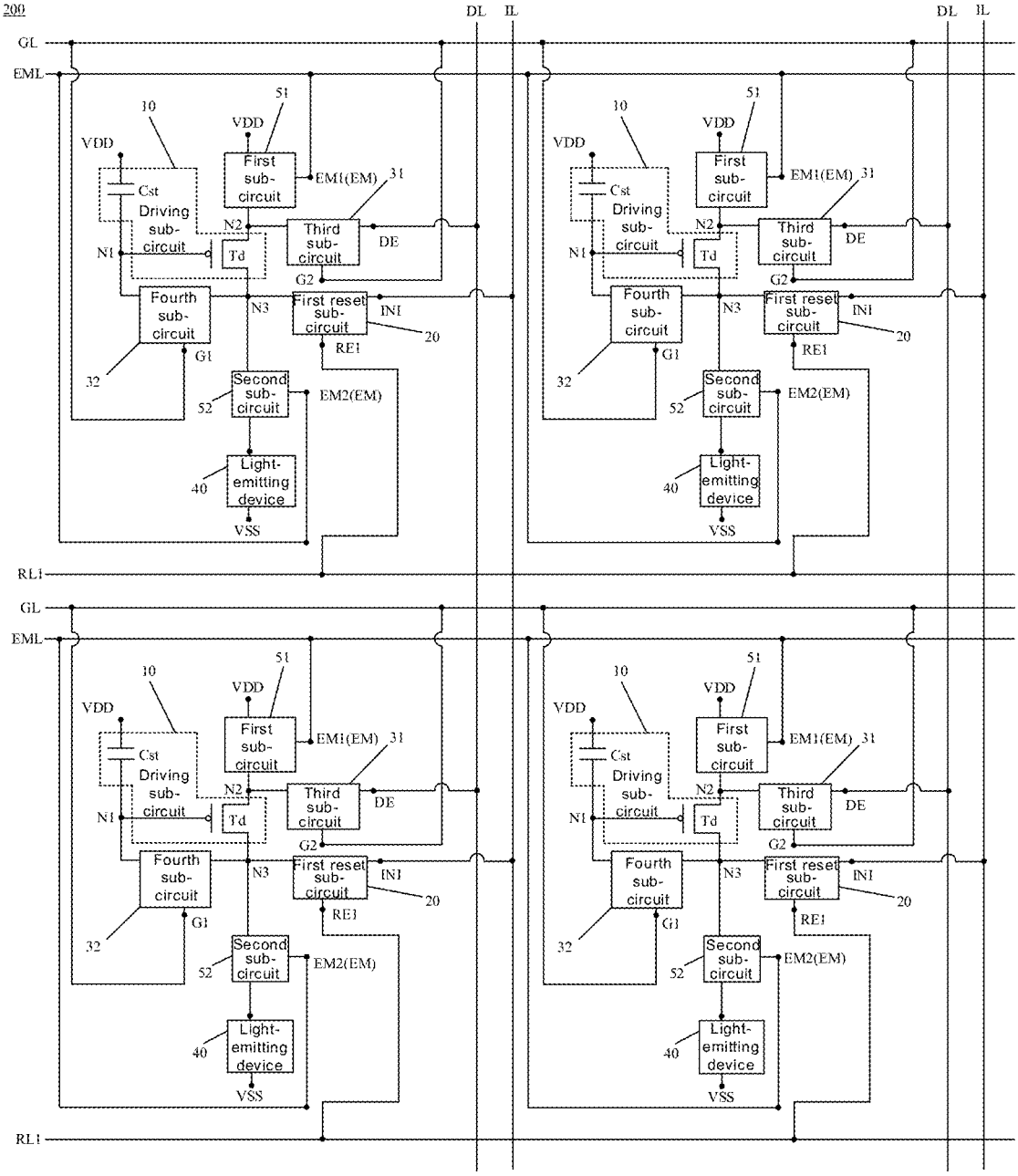
FIG. 6C is a diagram showing connections of circuits in yet another display panel provided in embodiments of the present disclosure.

For example, as shown in FIG. 6C, the display panel 200 includes a plurality of enable signal lines EML, and first enable signal terminals EM1 and second enable signal terminals EM2 to which all pixel circuits 100 located in a same row are connected are connected to an enable signal line EML. That is, the enable signal terminals EM to which all the pixel circuits 100 located in the same row are connected are connected to one enable signal line EML.

Figure 7:
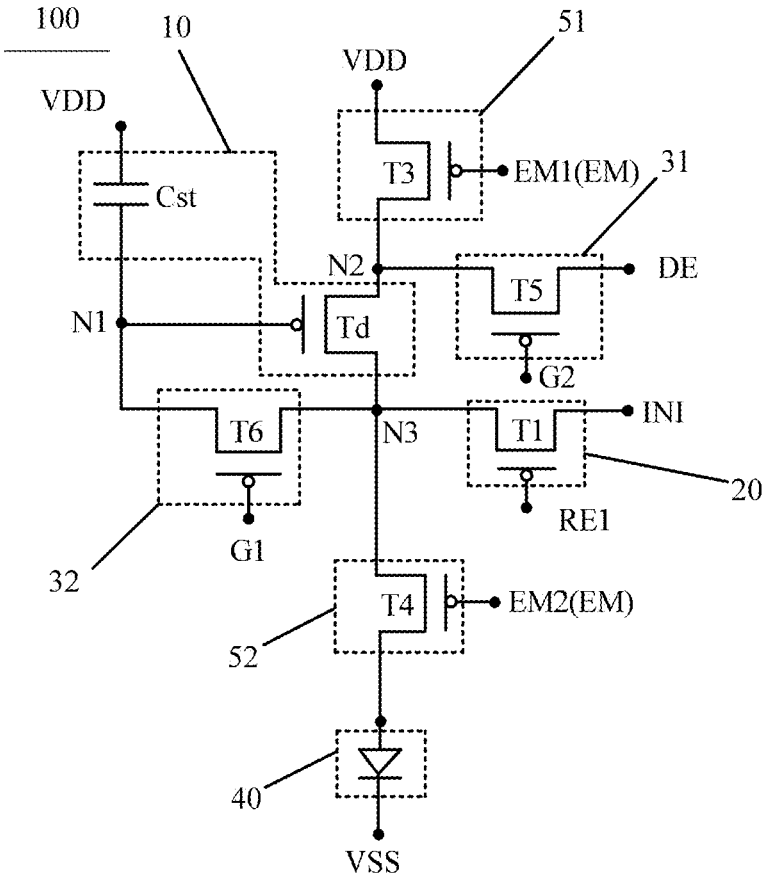
FIG. 7 is a diagram showing a structure of a pixel circuit provided in embodiments of the present disclosure.

In some examples, as shown in FIG. 7, the first reset sub-circuit 20 includes a first transistor T1. A gate of the first transistor T1 is connected to the first reset signal terminal RE1, a first electrode of the first transistor T1 is connected to the initialization signal terminal INI, and a second electrode of the first transistor T1 is connected to the third node N3.

In some other examples, the first reset sub-circuit 20 includes a plurality of first transistors T1 connected in parallel or in series. In a case where the first reset sub-circuit 20 includes the plurality of first transistors T1 connected in parallel, gates of the plurality of first transistors T1 are connected to the first reset signal terminal RE1, first electrodes of the plurality of first transistors T1 are connected to the initialization signal terminal INI, and second electrodes of the plurality of first transistors T1 are connected to the third node N3. In a case where the first reset sub-circuit 20 includes the plurality of first transistors T1 connected in series, the plurality of first transistors T1 are connected in sequence. A second electrode of a first transistor T1 is connected to a first electrode of a second first transistor T1, and so on. The gates of the plurality of first transistors T1 are connected to the first reset signal terminal RE1, and a first electrode of the first transistor T1 in the plurality of first transistors T1 is connected to the initialization signal terminal INI, a second electrode of a last first transistor T1 in the plurality of first transistors T1 is connected to the third node N3. The above descriptions are merely examples of the first reset sub-circuit 20, and other structures with the same function as the first reset sub-circuit 20 will not be repeated here, but shall all be included in the protection scope of the present disclosure.

In some examples, as shown in FIG. 7, the first sub-circuit 51 includes a third transistor T3. A gate of the third transistor T3 is connected to the first enable signal terminal EM1, a first electrode of the third transistor T3 is connected to the first voltage terminal VDD, and a second electrode of the third transistor T3 is connected to the second node N2.

In some other examples, the first sub-circuit 51 includes a plurality of third transistors T3 connected in parallel or in series. In a case where the first sub-circuit 51 includes the plurality of third transistors T3 connected in parallel, gates of the plurality of third transistors T3 are connected to the first enable signal terminal EM1, first electrodes of the plurality of third transistors T3 are connected to the first voltage terminal VDD, and second electrodes of the plurality of third transistors T3 are connected to the second node N2. In a case where the first sub-circuit 51 includes the plurality of third transistors T3 connected in series, the plurality of third transistors T3 are connected in sequence. A second electrode of a first third transistor T3 is connected to a first electrode of a second third transistor T3, and so on. The gates of the plurality of third transistors T3 are all connected to the first enable signal terminal EM1, a first electrode of the first third transistor T3 in the plurality of third transistors T3 is connected to the first voltage terminal VDD, and a second electrode of a last third transistor T3 in the plurality of third transistors T3 is connected to the second node N2. The above descriptions are merely examples of the first sub-circuit 51, and other structures with the same function as the first sub-circuit 51 will not be repeated here, but shall all be included in the protection scope of the present disclosure.

In some examples, as shown in FIG. 7, the second sub-circuit 52 includes a fourth transistor T4. A gate of the fourth transistor T4 is connected to the second enable signal terminal EM2, a first electrode of the fourth transistor T4 is connected to the third node N3, and a second electrode of the fourth transistor T4 is connected to the anode of the light-emitting device 40.

In some other examples, the second sub-circuit 52 includes a plurality of fourth transistors T4 connected in parallel or in series. In a case where the second sub-circuit 52 includes the plurality of fourth transistors T4 connected in parallel, gates of the plurality of fourth transistors T4 are connected to the second enable signal terminal EM2, first electrodes of the plurality of fourth transistors T4 are connected to the third node N3, and second electrodes of the plurality of fourth transistors T4 are connected to the anode of the light-emitting device 40. In a case where the second sub-circuit 52 includes the plurality of fourth transistors T4 connected in series, the plurality of fourth transistors T4 are connected in sequence. A second electrode of a first fourth transistor T4 is connected to a first electrode of a second fourth transistor T4, and so on. The gates of the plurality of fourth transistors T4 are connected to the second enable signal terminal EM2, a first electrode of the first fourth transistor T4 in the plurality of fourth transistors T4 is connected to the third node N3, and a second electrode of a last fourth transistor T4 in the plurality of fourth transistors T4 is connected to the anode of the light-emitting device 40. The above descriptions are merely examples of the second sub-circuit 52, and other structures with the same function as the second sub-circuit 52 will not be repeated here, but shall all be included in the protection scope of the present disclosure.

In some examples, as shown in FIG. 7, the third sub-circuit 31 includes a fifth transistor T5. A gate of the fifth transistor T5 is connected to the second scanning terminal G2, a first electrode of the fifth transistor T5 is connected to the data terminal DE, and a second electrode of the fifth transistor T5 is connected to the second node N2.

In some other examples, the third sub-circuit 31 includes a plurality of fifth transistors T5 connected in parallel or in series. In a case where the third sub-circuit 31 includes the plurality of fifth transistors T5 connected in parallel, gates of the plurality of fifth transistors T5 are connected to the second scanning terminal G2, first electrodes of the plurality of fifth transistors T5 are connected to the data terminal DE, and second electrodes of the plurality of fifth transistors T5 are connected to the second node N2. In a case where the third sub-circuit 31 includes the plurality of fifth transistors T5 connected in series, the plurality of fifth transistors T5 are connected in sequence. A second electrode of a first fifth transistor T5 is connected to a first electrode of a second fifth transistor T5, and so on. The gates of the plurality of fifth transistors T5 are connected to the second scanning terminal G2, a first electrode of the first fifth transistor T5 in the plurality of fifth transistors T5 is connected to the data terminal DE, and a second electrode of a last fifth transistor T5 in the plurality of fifth transistors T5 is connected to the second node N2. The above descriptions are merely examples of the third sub-circuit 31, and other structures with the same function as the third sub-circuit 31 will not be repeated here, but shall all be included in the protection scope of the present disclosure.

In some examples, as shown in FIG. 7, the fourth sub-circuit 32 includes a sixth transistor T6. A gate of the sixth transistor T6 is connected to the first scanning terminal G1, a first electrode of the sixth transistor T6 is connected to the third node N3, and a second electrode of the sixth transistor T6 is connected to the first node N1.

In some other examples, the fourth sub-circuit 32 includes a plurality of sixth transistors T6 connected in parallel or in series. In a case where the fourth sub-circuit 32 includes the plurality of sixth transistors T6 connected in parallel, gates of the plurality of sixth transistors T6 are connected to the first scanning terminal G1, first electrodes of the plurality of sixth transistors T6 are connected to the third node N3, and second electrodes of the plurality of sixth transistors T6 are connected to the first node N1. In a case where the fourth sub-circuit 32 includes the plurality of sixth transistors T6 connected in series, the plurality of sixth transistors T6 are connected in sequence. A second electrode of a first sixth transistor T6 is connected to a first electrode of a second sixth transistor T6, and so on. The gates of the plurality of sixth transistors T6 are connected to the first scanning terminal G1, a first electrode of the first sixth transistor T6 in the plurality of sixth transistors T6 is connected to the third node N3, and a second electrode of a last sixth transistor T6 in the plurality of sixth transistors T6 is connected to the first node N1. The above descriptions are merely examples of the fourth sub-circuit 32, and other structures with the same function as the fourth sub-circuit 32 will not be repeated here, but shall all be included in the protection scope of the present disclosure.

It will be noted that the embodiments of the present disclosure do not limit types of the transistors in the sub-circuits. That is, the driving transistor Td, the first transistor T1, the third transistor T3, the fourth transistor T4, the fifth transistor T5 and the sixth transistor T6 may all be P-type transistors or N-type transistors. The following embodiments will be illustrated by considering an example in which the driving transistor Td, the first transistor T1, the third transistor T3, the fourth transistor T4, the fifth transistor T5, and the sixth transistor T6 are all P-type transistors.

In addition, a first electrode is one of a source and a drain of the transistor, and a second electrode is the other of the source and the drain of the transistor. Since the source and the drain of the transistor may be symmetrical in structure, there may be no difference in structure between the source and the drain of the transistor. That is to say, there is no difference in structure between the first electrode and the second electrode of the transistor in the embodiments of the present disclosure. For the P-type driving transistor Td, the second electrode thereof is referred to as the drain, and the first electrode thereof is referred to as the source. For the N-type driving transistor Td, the first electrode thereof is referred to as the drain, and a second electrode thereof is referred to as the source.

Some possible implementation manners are provided below to describe the pixel circuit 100 and a driving process thereof.

The driving process of the pixel circuit 100 in an image frame may be divided into an initialization phase, a data writing phase, and a light-emitting phase.

A first possible implementation manner is as follows.

As shown in FIG. 7, the first reset sub-circuit 20 includes the first transistor T1, the first sub-circuit 51 includes the third transistor T3, the second sub-circuit 52 includes the fourth transistor T4, the third sub-circuit 31 includes the fifth transistor T5, and the fourth sub-circuit 32 includes the sixth transistor T6. The first enable signal terminal EM1 and the second enable signal terminal EM2 are connected to a same enable signal terminal EM.

Figure 8:
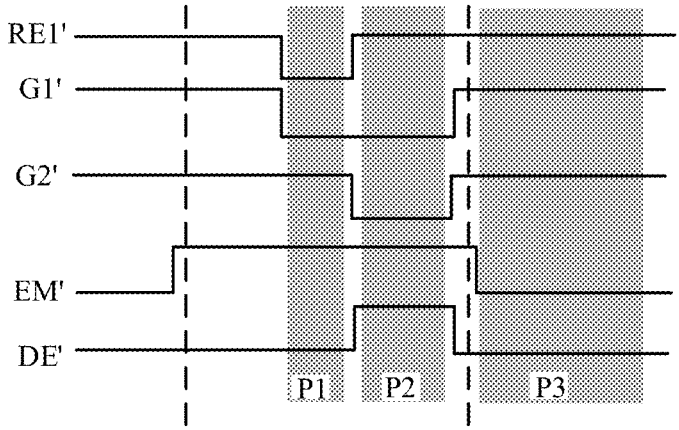
FIG. 8 is a timing diagram of the pixel circuit shown in FIG. 7.

As shown in FIG. 8, in the initialization phase P1, a voltage of the first reset signal RE1' transmitted by the first reset terminal RE1 and a voltage of the first scanning signal G1' transmitted by the first scanning terminal G1 are at low levels, and a voltage of an enable signal EM' transmitted by the enable signal terminal EM and a voltage of the second scanning signal G2' transmitted by the second scanning terminal G2 are at high levels.

As shown in FIG. 7, the first reset sub-circuit 20 transmits the initialization signal from the initialization signal terminal INI to the third node N3 under the control of the first reset signal. The fourth sub-circuit 32 transmits the initialization signal at the third node N3 to the first node N1 under the control of the first scan signal, so as to initialize the first node N1 through the initialization signal, thereby preventing an electrical signal remained at the first node N1 in a previous image frame from affecting a current image frame.

Figure 9A:
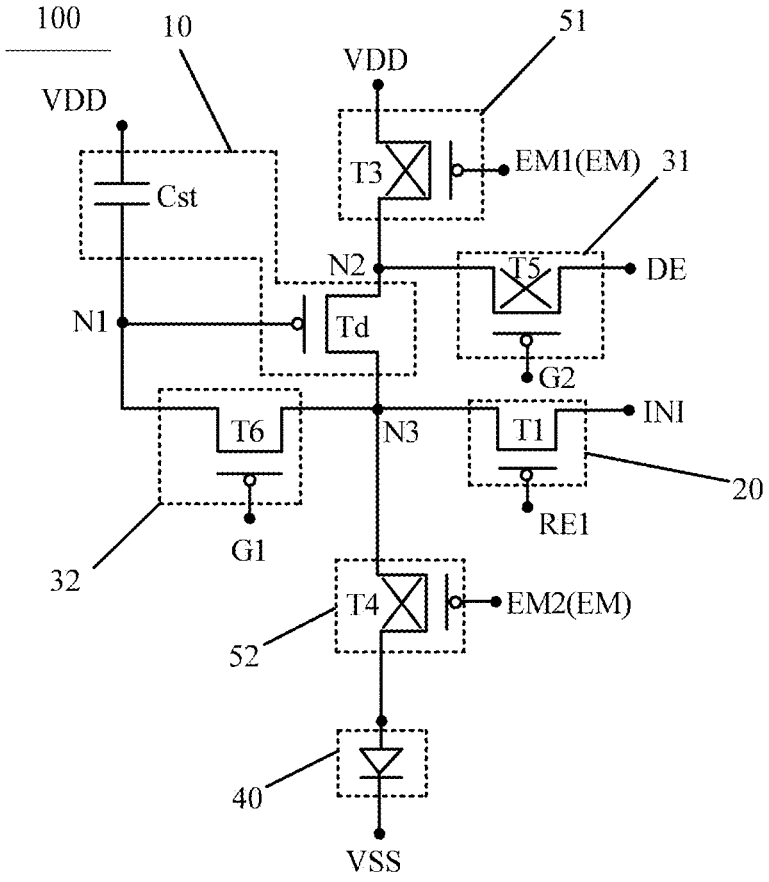
FIG. 9A is a schematic diagram of the pixel circuit shown in FIG. 7 in an initialization phase.

FIG. 9A is an equivalent circuit diagram of the pixel circuit 100 shown in FIG. 7 in the initialization phase P1. As shown in FIG. 9A, the first reset signal controls the first transistor T1 to be turned on, and the initialization signal transmitted by the initialization signal terminal INI is transmitted to the third node N3 through the first transistor T1. The first scanning signal controls the sixth transistor T6 to be turned on, and the initialization signal is transmitted to the first node N1 through the sixth transistor T6.

In addition, the first sub-circuit 51, the second sub-circuit 52 and the third sub-circuit 31 are all in an off state in the initialization phase P1. In this case, as shown in FIG. 9A, the third transistor T3, the fourth transistor T4, and the fifth transistor T5 are all turned off. As shown in FIG. 9A, the turned-off transistors are marked with a symbol "X".

At an end of the initialization phase P1, the voltage of the first node N1 is $V_{init}$.

In the data writing phase P2, the voltage of the first scanning signal transmitted by the first scanning terminal G1 and the voltage of the second scanning signal transmitted by the second scanning terminal G2 are at low levels, and the voltage of the first reset signal transmitted by the first reset signal terminal RE1 and the voltage of the enable signal transmitted by the enable signal terminal EM are at high levels.

As shown in FIG. 7, the third sub-circuit 31 transmits the data signal DE' from the data terminal DE to the second node N2 under the control of the second scanning signal. The fourth sub-circuit 32 short-circuits the second electrode of the driving transistor Td and the gate of the driving transistor Td to form a diode structure under the control of the first scan signal, writes the data signal at the second node N2 to the first node N1, and performs the threshold voltage compensation on the driving transistor Td.

Figure 9B:
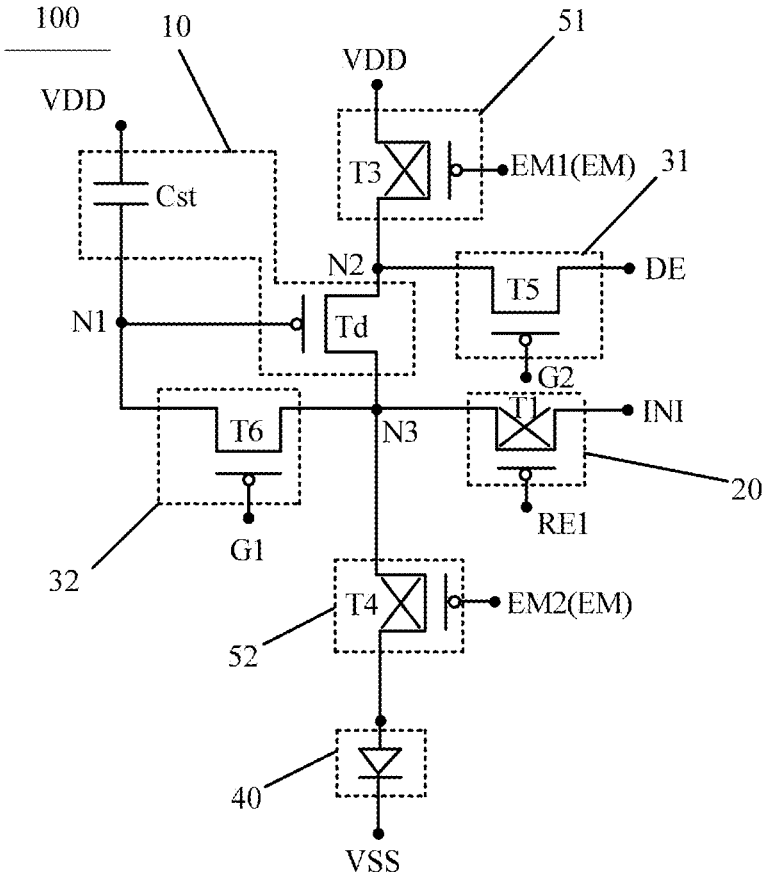
FIG. 9B is a schematic diagram of the pixel circuit shown in FIG. 7 in a data writing phase.

FIG. 9B is an equivalent circuit diagram of the pixel circuit 100 shown in FIG. 7 in the data writing phase P2. As shown in FIG. 9B, in the data writing phase P2, since the voltage of the first reset signal is at a high level, the first transistor T1 is turned off. Since the voltage of the second scanning signal is at a low level, the fifth transistor T5 is controlled to be turned on, and the data signal from the data terminal DE is transmitted to the second node N2 through the fifth transistor T5. Same as the initialization phase P1, the voltage of the first scanning signal in the data writing phase P2 is still at a low level, and the sixth transistor T6 remains turned on, so that the second electrode and the gate of the driving transistor Td are short-circuited to form the diode structure. The data signal at the second node N2 is transmitted to the first node N1 through the driving transistor Td and the sixth transistor T6. When a difference between the voltage of the first node N1 and a voltage of the second node N2 is reduced to the threshold voltage Vth of the driving transistor Td, the driving transistor Td is turned off.

At an end of the data writing phase P2, the voltage of the first node N1 is $V_{data}$+Vth, which is stored in the storage capacitor Cst. Here, $V_{data}$ is a voltage of the data signal.

In the light-emitting phase P3, the voltage of the enable signal transmitted by the enable signal terminal EM is at a low level, and the voltage of the first scanning signal transmitted by the first scanning terminal G1, the voltage of the second scanning signal transmitted by the second scanning terminal G2 and the voltage of the first reset signal transmitted by the first reset signal terminal RE1 are all at high levels.

As shown in FIG. 7, the first sub-circuit 51 transmits the voltage signal of the first voltage terminal VDD to the second node N2 under control of the enable signal. The driving transistor Td generates a current under control of the voltage on the first node N1 and the voltage signal of the first voltage terminal VDD. The second sub-circuit 52 transmits the current output by the driving transistor Td to the light-emitting device 40 under the control of the enable signal.

Figure 9C:
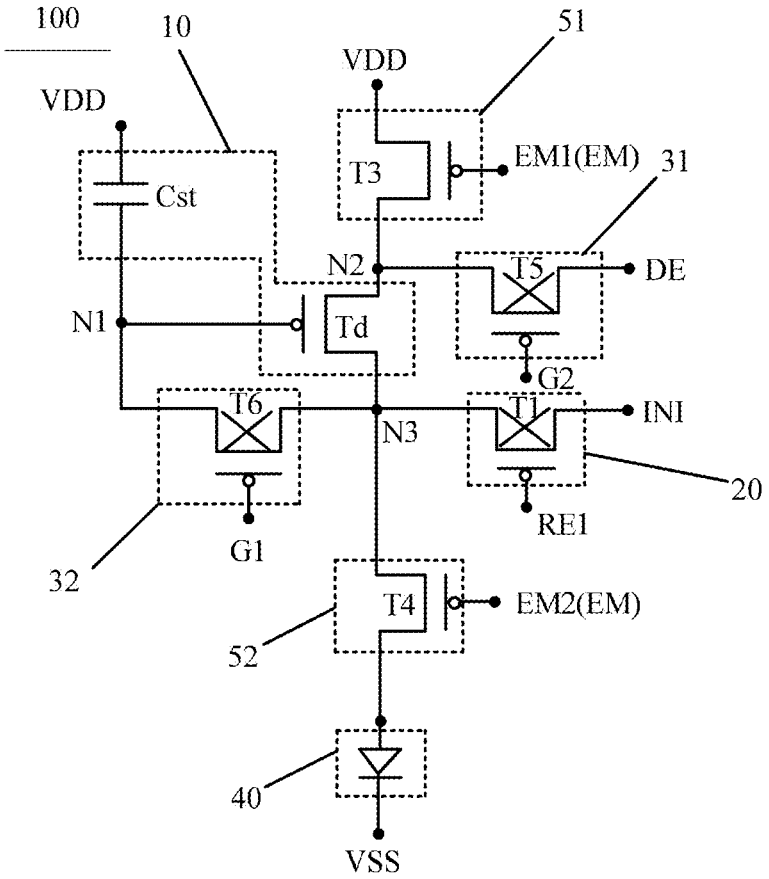
FIG. 9C is a schematic diagram of the pixel circuit shown in FIG. 7 in a light-emitting phase.

FIG. 9C is an equivalent circuit diagram of the pixel circuit 100 shown in FIG. 7 in the light-emitting phase P3. As shown in FIG. 9C, since the voltage of the first reset signal is at a high level, the first transistor T1 is turned off. Since the voltage of the first scanning signal is at a high level, the sixth transistor T6 is turned off. Since the voltage of the second scanning signal is at a high level, the fifth transistor T5 is turned off. Since the enable signal is at the low level, the third transistor T3 and the fourth transistor T4 are turned on. The voltage signal of the first voltage terminal VDD is transmitted to the second node N2 through the third transistor T3. The driving transistor Td generates the current under the control of the voltage on the first node N1 and the voltage signal of the first voltage terminal VDD. The current is transmitted to the light-emitting device 40 through the fourth transistor T4, so that the light-emitting device 40 emits light.

In the light-emitting phase P3, the voltage of the first node N1 is $V_{data}$+Vth, the voltage of the second node N2 is Vdd, and the gate-source voltage Vgs of the driving transistor Td is equal to Vg−Vs, and is equal to $V_{data}$+Vth−Vdd (i.e., Vgs=Vg−Vs=$V_{data}$+Vth−Vdd). Here, Vg is the voltage of the gate of the driving transistor Td, and Vs is a voltage of the source of the driving transistor Td.

After the driving transistor Td is turned on, when a difference between a gate-source voltage Vgs of the driving transistor Td and the threshold voltage Vth of the driving transistor Td is less than or equal to a drain-source voltage Vds of the driving transistor Td, that is, when Vgs−Vth≤Vds, the driving transistor Td may be in a saturation and on state. In this case, the current I output by the driving transistor Td is obtained by a formula:

$$\begin{aligned} I &= \frac{1}{2}\mu C_{ox}\frac{W}{L}(Vgs - Vth)^2 \\ &= \frac{1}{2}\mu C_{ox}\frac{W}{L}(V_{data} + Vth - Vdd - Vth)^2 \\ &= \frac{1}{2}\mu C_{ox}\frac{W}{L}(V_{data} - Vdd)^2 \end{aligned} \tag{2}$$

Here, W/L is the width-to-length ratio of the driving transistor Td, Cox is a dielectric constant of a channel insulating layer of the driving transistor Td, and μ is a channel carrier mobility of the driving transistor Td.

The current output by the driving transistor Td is only related to the structure of the driving transistor Td, the data signal transmitted by the data terminal DE and the voltage signal transmitted by the first voltage terminal VDD, and are not related to the threshold voltage Vth of the driving transistor Td, which eliminates the effect of the threshold voltage Vth of the driving transistor Td on the brightness of the light-emitting device 40, and improves brightness uniformity of the display panel.

A second possible implementation manner is as follows.

As shown in FIG. 10, based on the first possible implementation manner, the first scanning terminal G1 and the second scanning terminal G2 are connected to a same scanning terminal G. Based on this, FIG. 11 shows a timing diagram of the pixel circuit 100 shown in FIG. 10.

Figure 11:
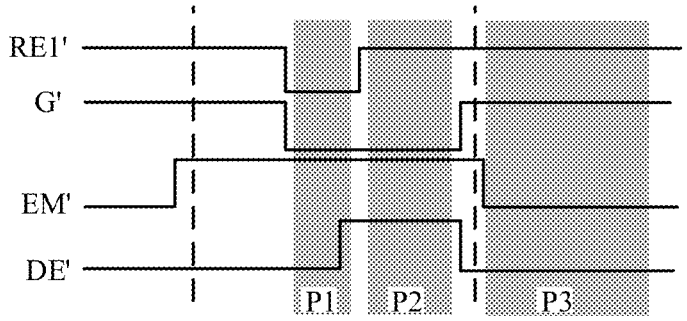
FIG. 11 is a timing diagram of the pixel circuit shown in FIG. 10.

As shown in FIG. 11, in the initialization phase P1, the voltage of the first reset signal RE1' transmitted by the first reset signal terminal RE1 and a voltage of a scanning signal G' transmitted by the scanning terminal G are at low levels, and the voltage of the enable signal EM' transmitted by the enable signal terminal EM is at a high level.

Figure 12A:
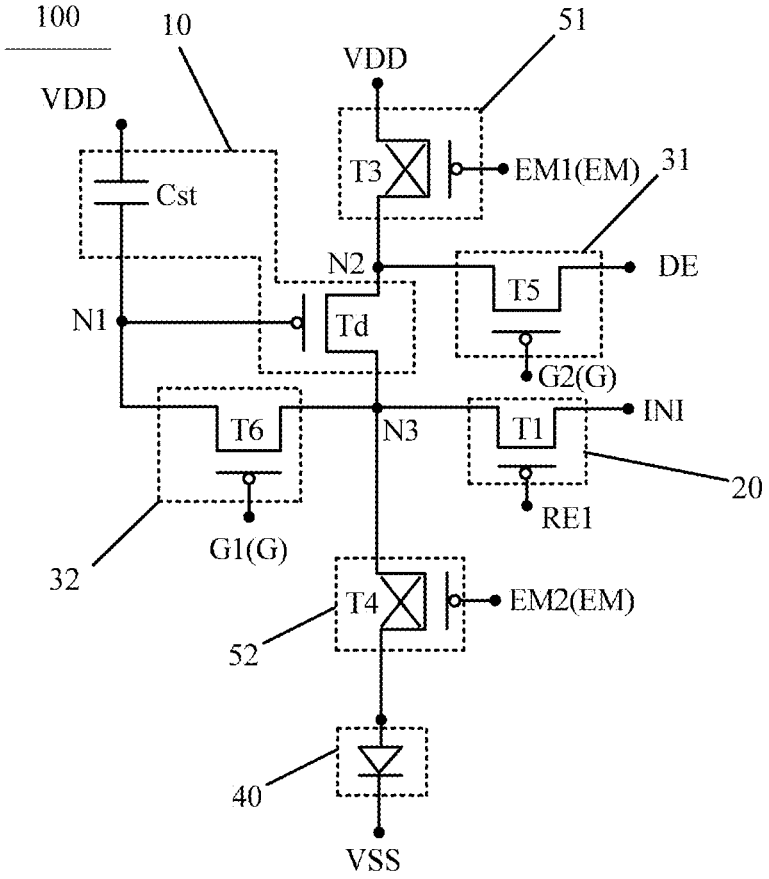
FIG. 12A is a schematic diagram of the pixel circuit shown in FIG. 10 in an initialization phase.

FIG. 12A is an equivalent circuit diagram of the pixel circuit 100 shown in FIG. 10 in the initialization phase P1. As shown in FIG. 12A, in the initialization phase P1, the voltage of the first reset signal is at a low level, and controls the first transistor T1 to be turned on, so that the initialization signal transmitted by the initialization signal terminal INI is transmitted to the third node N3 through the first transistor T1. Since the voltage of the scanning signal is at a low level, the sixth transistor T6 is turned on, and the initialization signal is transmitted to the first node N1 through the sixth transistor T6.

In addition, the voltage of the enable signal is at the high level in the initialization phase P1, so that the first sub-circuit 51 and the second sub-circuit 52 are in an off state. As shown in FIG. 12A, the third transistor T3 and the fourth transistor T4 are turned off.

As shown in FIG. 11, in the data writing phase P2, the voltage of the scanning signal transmitted by the scanning terminal G is at a low level, and the voltage of the first reset signal transmitted by the first reset signal terminal RE1 and the voltage of the enable signal transmitted by the enable signal terminal EM are at high levels.

Figure 12B:
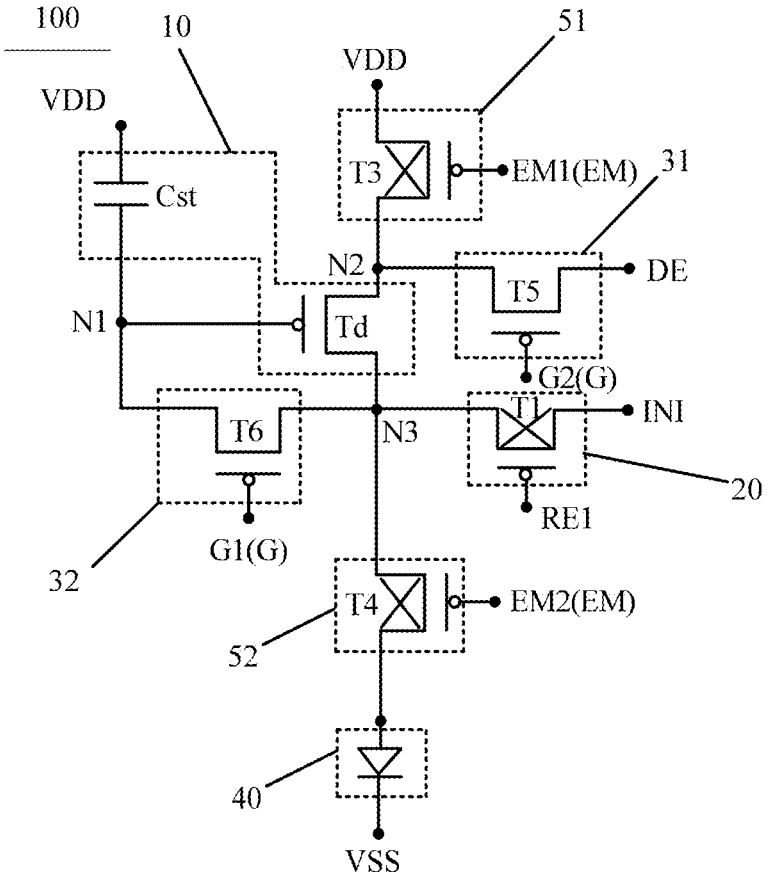
FIG. 12B is a schematic diagram of the pixel circuit shown in FIG. 10 in a data writing phase.

FIG. 12B is an equivalent circuit diagram of the pixel circuit 100 shown in FIG. 10 in the data writing phase P2. As shown in FIG. 12B, in the data writing phase P2, since the voltage of the first reset signal is at a high level, the first transistor T1 is turned off. Since the voltage of the scanning signal is at the low level, the fifth transistor T5 and the sixth transistor T6 are controlled to be turned on, and the data signal from the data terminal DE is transmitted to the second node N2 through the fifth transistor T5. The sixth transistor T6 is turned on, and the second electrode and the gate of the driving transistor Td are short-circuited to form a diode structure, and the data signal at the second node N2 is transmitted to the first node N1 through the driving transistor Td and the sixth transistor T6. When a difference between the voltage of the first node N1 and a voltage of the second node N2 is reduced to the threshold voltage Vth of the driving transistor Td, the driving transistor Td is turned off.

An on state of each transistor and transmission processes of signals in the light-emitting phase P3 in the second possible implementation manner are the same as those in the light-emitting phase P3 in the first possible implementation manner, which will not be repeated here.

It will be noted that, in the second possible implementation manner, in the initialization phase P1, since the voltage of the scanning signal is at the low level, the fifth transistor T5 is in an on state, and the data terminal DE transmits the data signal. However, the a difference between a voltage of the data terminal DE and the voltage of the first node N1 is less than a difference between the voltage of the data terminal DE and a voltage of the initialization signal terminal INI, and the data signal of the data terminal DE is transmitted to the first node N1 through the fifth transistor T5, the driving transistor Td and the sixth transistor T6, so that the data signal has a small effect on the voltage N1' (e.g., as shown in FIG. 13) of the first node N1 in the initialization phase P1.

Figure 13:
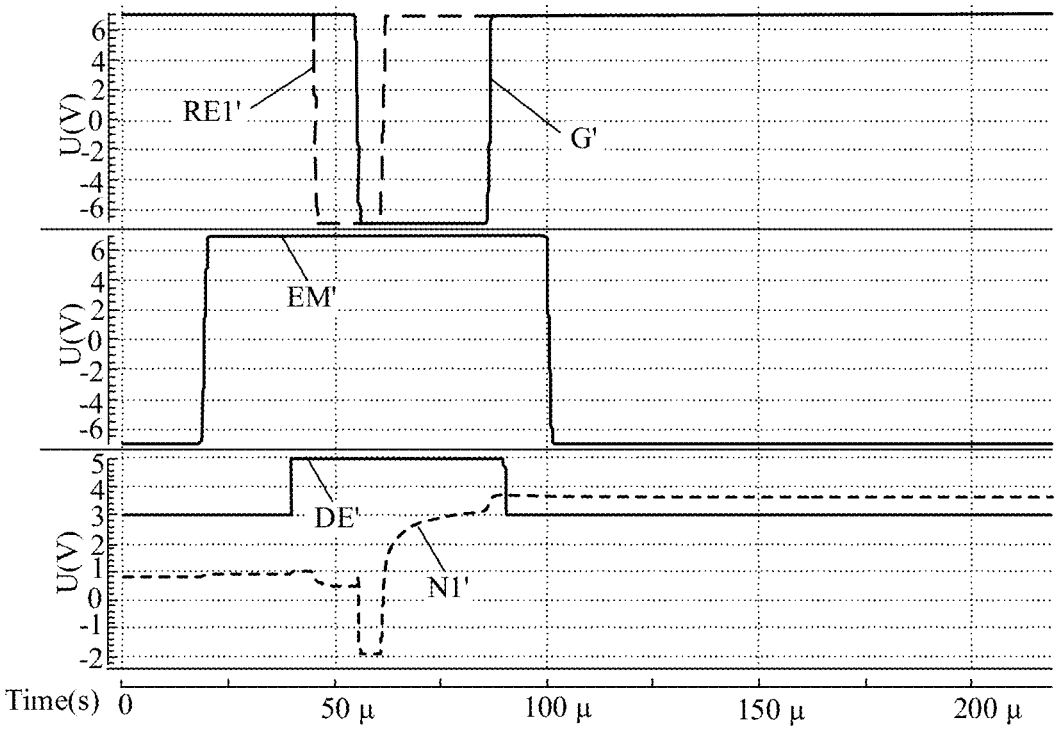
FIG. 13 is a diagram showing a simulation result of signals of a pixel circuit provided in embodiments of the present disclosure.

FIG. 13 shows a simulation result of signals in the driving process of the pixel circuit 100 in one image frame in the second possible implementation manner. It can be seen from FIG. 13 that normal initialization and writing of the data signal can be performed on the first node N1.

A third possible implementation manner is as follows.

Figure 14:
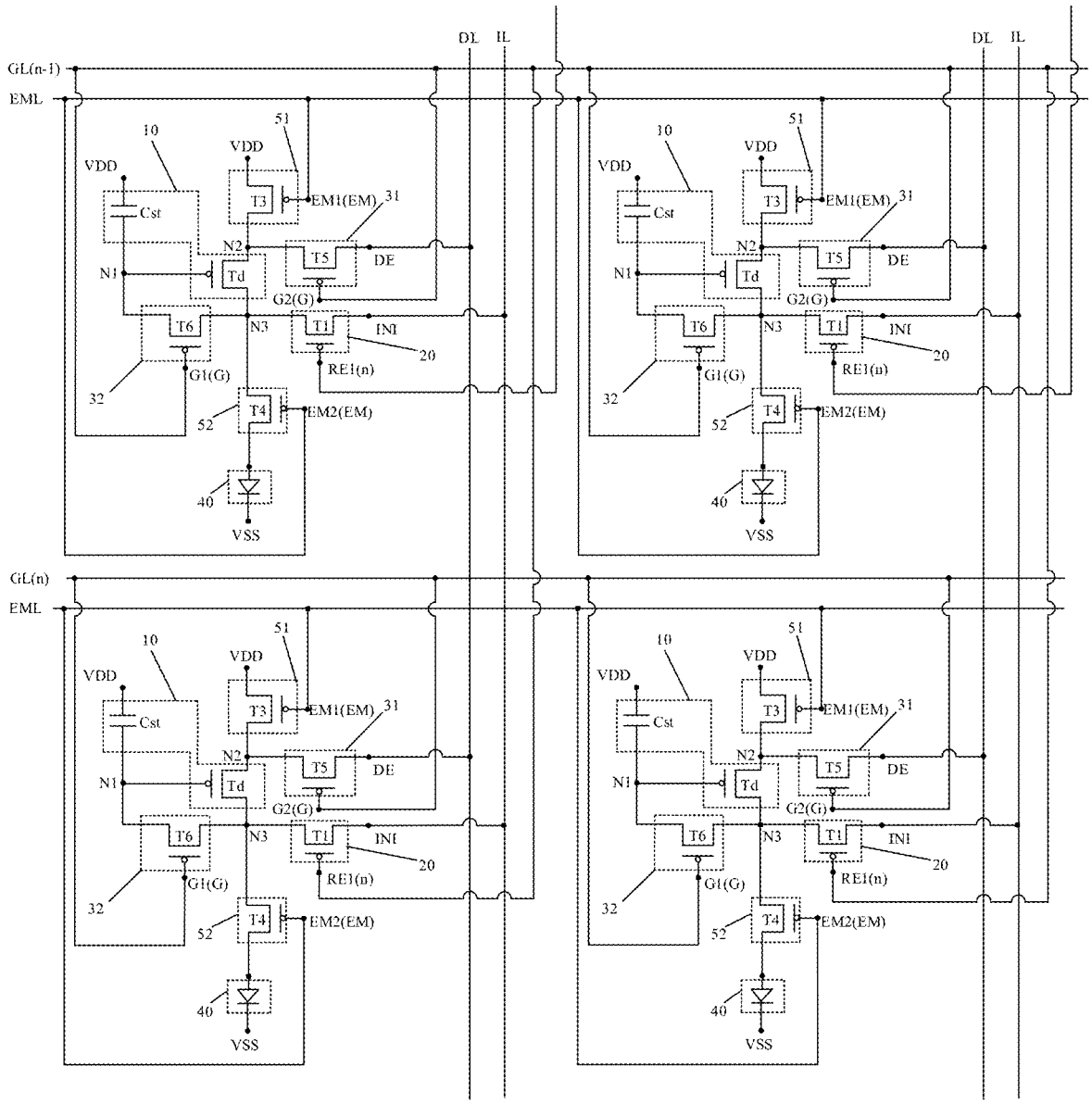
FIG. 14 is a diagram showing connections of circuits in yet another display panel provided in embodiments of the present disclosure.
Figure 15:
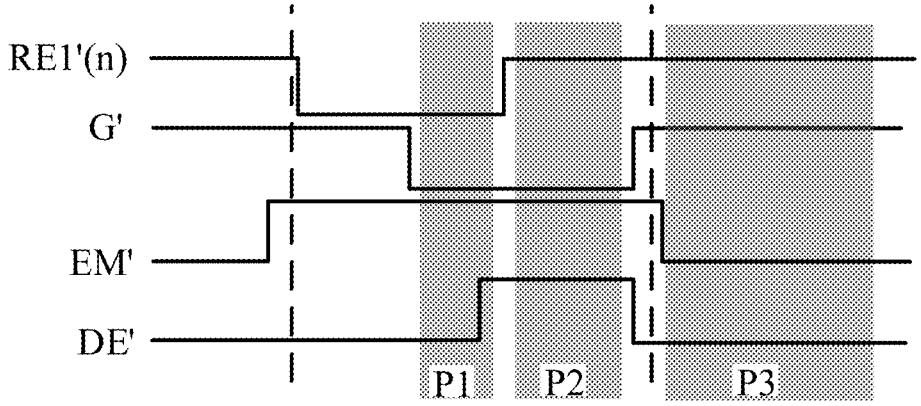
FIG. 15 is a timing diagram of a pixel circuit in the display panel shown in FIG. 14.

As shown in FIG. 14, first scanning terminals G1 and second scanning terminals G2 to which all pixel circuits located in a same row are connected are connected to a scanning line GL, and first reset signal terminals RE1(*n*) to which all pixel circuits 100 located in an nth row are connected are connected to a scanning line GL(n−1) to which pixel circuits 100 located in an (n−1)th row are connected. In this case, a timing diagram corresponding to the pixel circuit 100 in FIG. 14 is shown in FIG. 15, and a driving process of the pixel circuit 100 in the third possible implementation manner is similar to that in the second possible implementation manner, which will not be repeated here. A difference is that, in the third possible implementation manner, in the initialization phase P1, a first reset signal RE1'(*n*) of the first reset signal terminals RE1(*n*) connected to the pixel circuits 100 located in the nth row is provided by the scanning line GL(n−1) that is connected to the pixel circuits 100 located in the (n−1)th row. Here, n is a positive integer greater than or equal to 2.

The first reset signal terminals RE1(*n*) to which all the pixel circuits 100 located in the nth row are connected are connected to the scanning line GL(n−1) corresponding to the pixel circuits 100 in the (n−1)th row, which may reduce the number of wirings in the display panel.

A fourth possible implementation manner is as follows.

Figure 16:
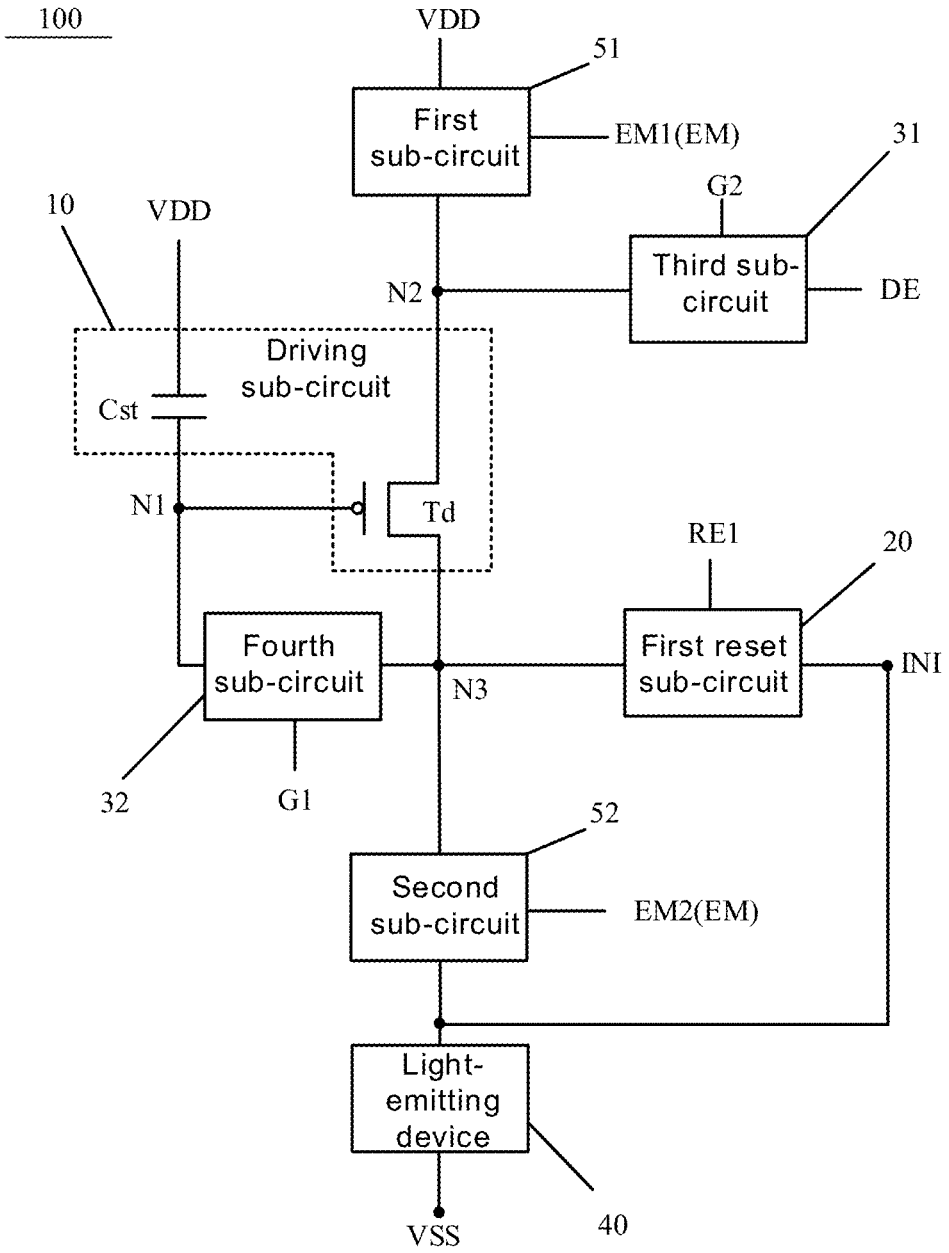
FIG. 16 is a structural diagram of yet another pixel circuit provided in embodiments of the present disclosure.

As shown in FIG. 16, the initialization signal terminal INI is connected to the anode of the light-emitting device 40. In this case, the first node N1 may be reset by a residual voltage of the anode of the light-emitting device 40, which may reduce the number of wirings in the display panel.

Figure 17:
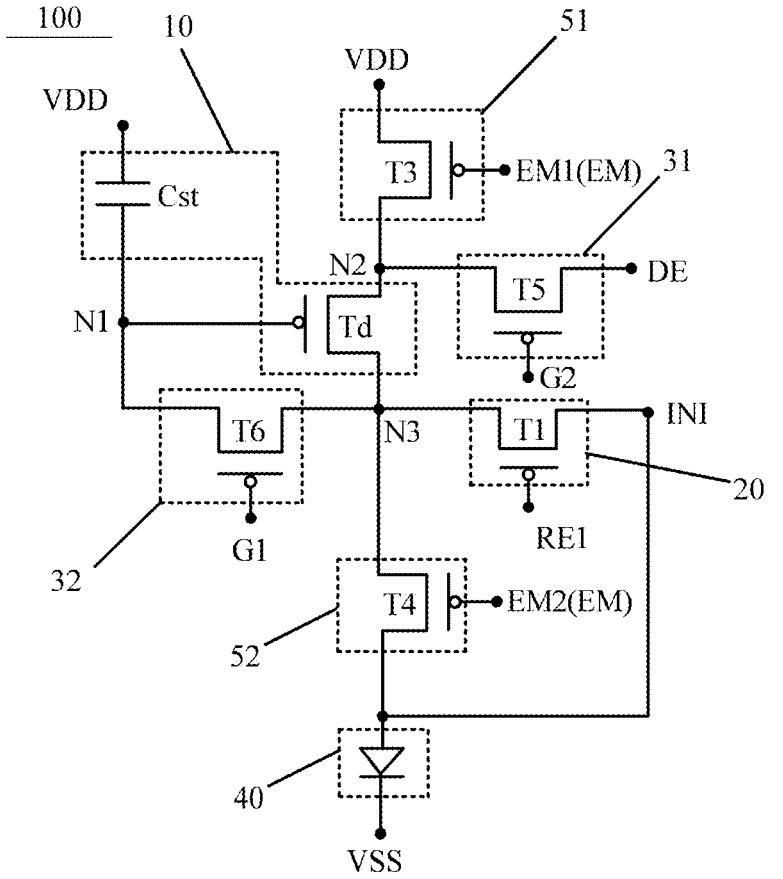
FIG. 17 is a diagram showing a structure of the pixel circuit shown in FIG. 16.
Figure 18:
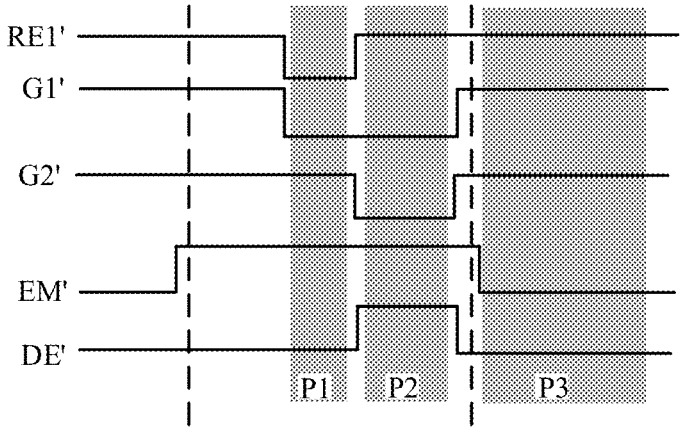
FIG. 18 is a timing diagram of the pixel circuit shown in FIG. 17.

For example, a structure of the pixel circuit 100 is shown in FIG. 17, and a timing diagram corresponding to the pixel circuit 100 in FIG. 17 is shown in FIG. 18. A driving process of the pixel circuit 100 in the fourth possible implementation manner is similar to the driving process of the pixel circuit 100 in the first possible implementation manner. A difference is that, in the fourth possible implementation manner, in the initialization phase P1, the first node N1 is reset by the residual voltage of the anode of the light-emitting device 40.

Figure 19:
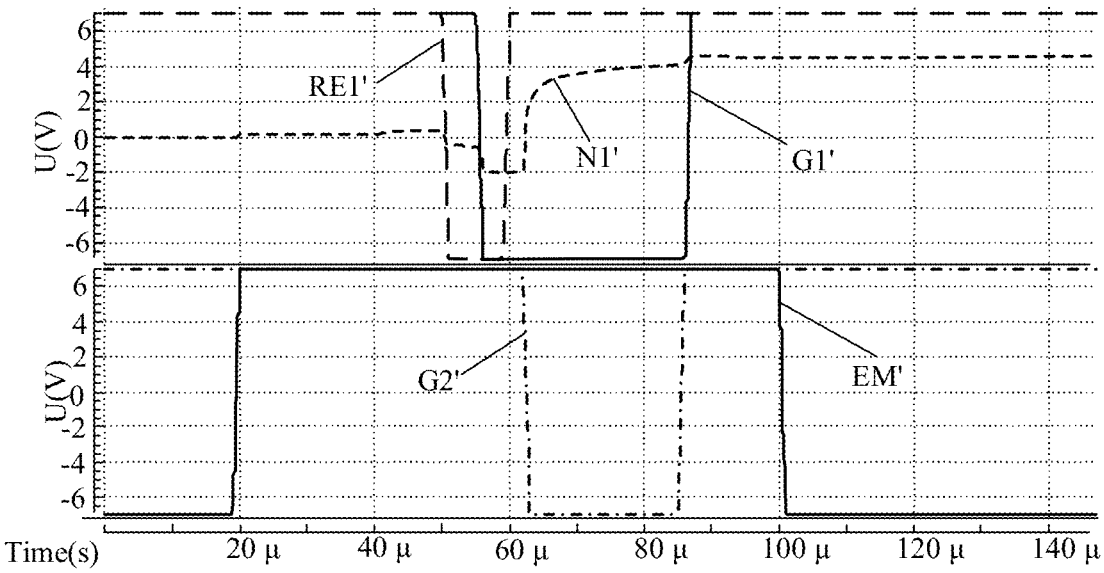
FIG. 19 is a diagram showing a simulation result of signals of another pixel circuit provided in embodiments of the present disclosure.

FIG. 19 shows a simulation result of signals in the driving process of the pixel circuit 100 in one image frame in the fourth possible implementation manner. It can be seen from FIG. 19 that normal initialization and writing of the data signal can be performed on the first node N1.

A fifth possible implementation manner is as follows.

Figure 20:
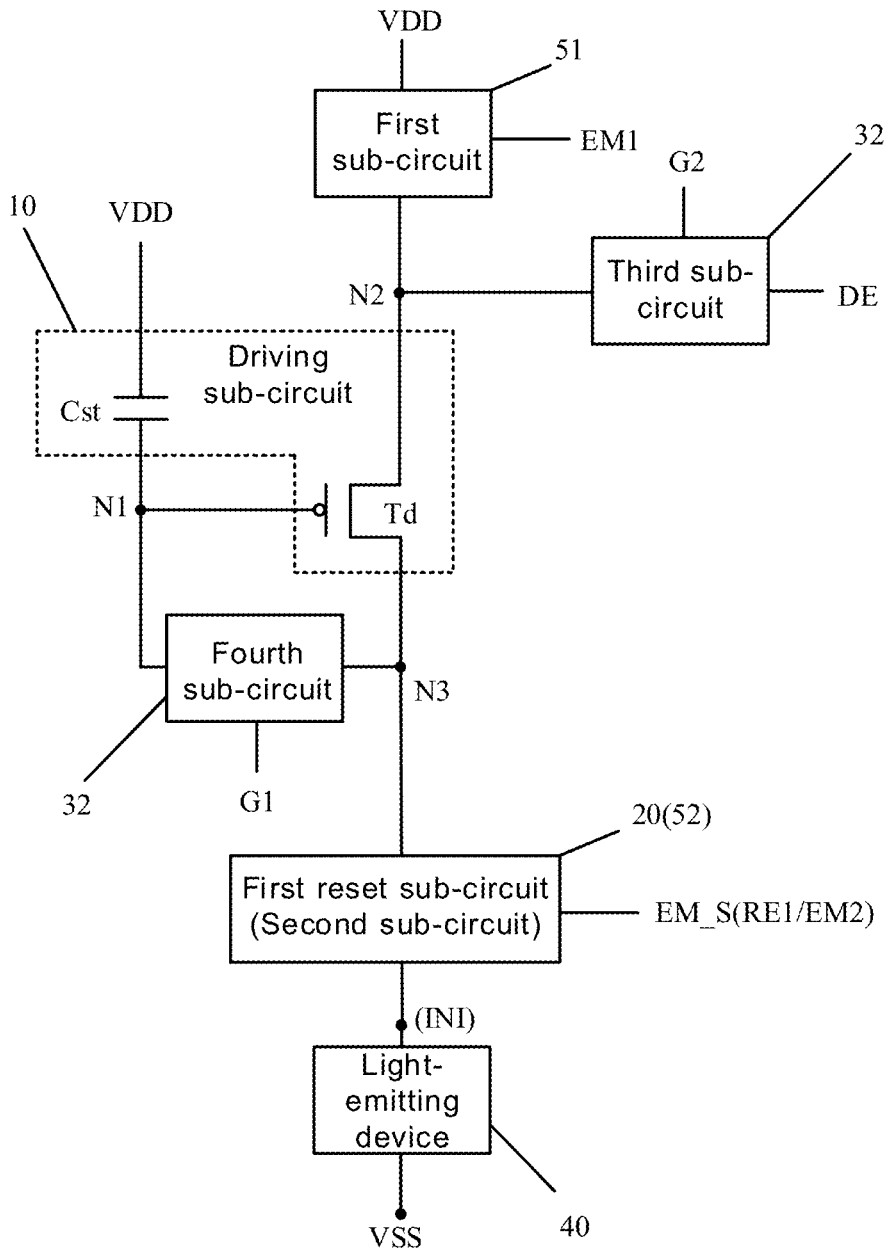
FIG. 20 is a structural diagram of yet another pixel circuit provided in embodiments of the present disclosure.

As shown in FIG. 20, the first reset sub-circuit 20 is used as the second sub-circuit 52, the initialization signal terminal INI is connected to the anode of the light-emitting device 40, and the first reset signal terminal RE1 and the second enable signal terminal EM2 are connected to a same signal terminal EM_S.

The signal terminal EM_S is configured to transmit the first reset signal in the initialization phase P1, and transmit the second enable signal in the light-emitting phase P3.

Figure 21:
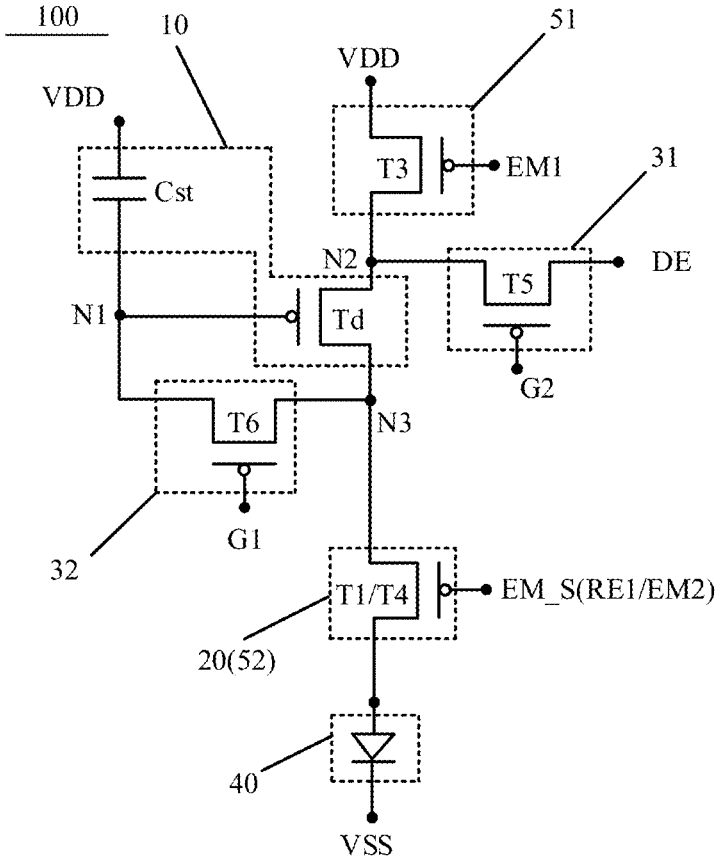
FIG. 21 is a diagram showing a structure of the pixel circuit shown in FIG. 20.
Figure 22:
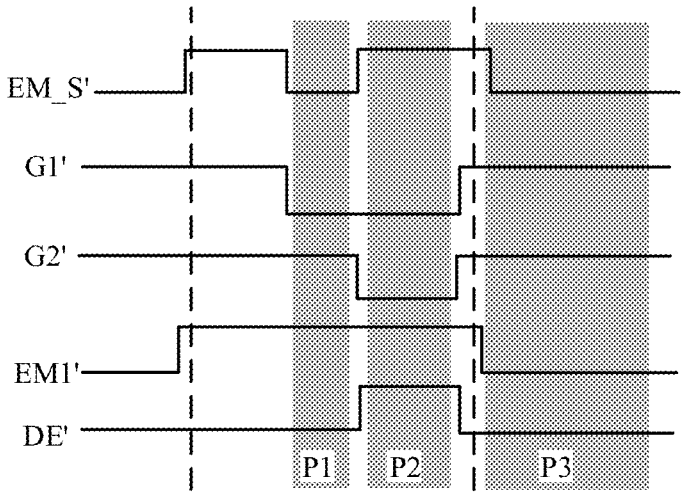
FIG. 22 is a timing diagram of the pixel circuit shown in FIG. 21.

For example, a structure of the pixel circuit 100 is shown in FIG. 21, and a timing diagram corresponding to the pixel circuit 100 in FIG. 21 is shown in FIG. 22. A driving process of the pixel circuit 100 is as follows.

As shown in FIG. 22, the signal terminal EM_S transmits a control signal EM_S', and the control signal includes the first reset signal or the second enable signal. The first scanning terminal G1 transmits the first scanning signal G1', and the second scanning terminal G2 transmits the second scanning signal G2'. The first enable signal terminal EM1 transmits the first enable signal EM1'.

In the initialization phase P1, the voltage of the first reset signal is at a low level; the first scanning signal is at a low level; and the voltage of first enable signal and the voltage of the second scanning signal are at high levels.

Figure 23A:
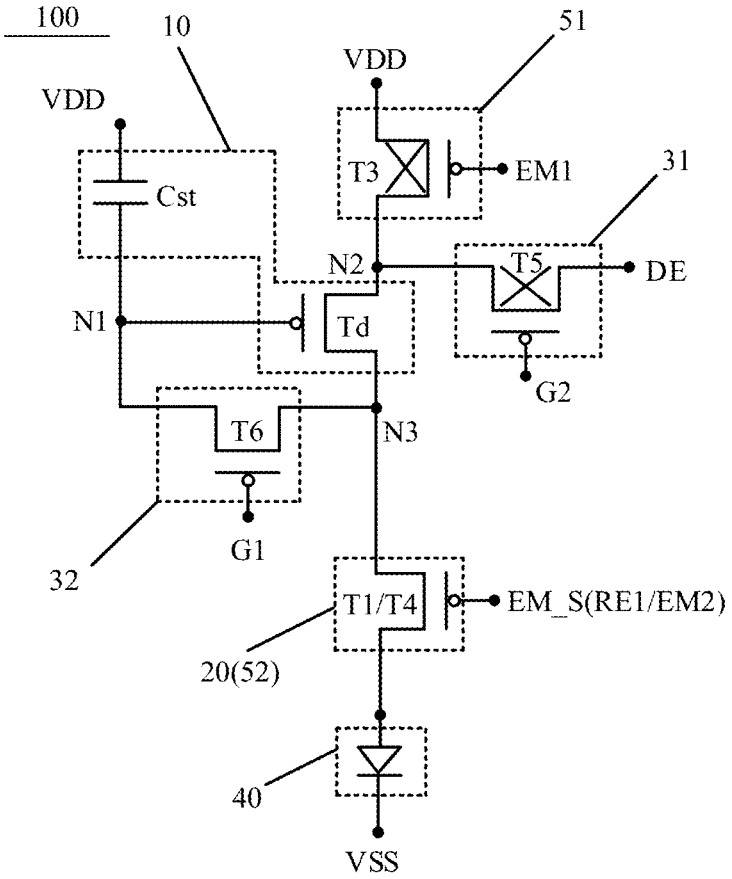
FIG. 23A is a schematic diagram of the pixel circuit shown in FIG. 21 in an initialization phase.

FIG. 23A is an equivalent circuit diagram of the pixel circuit 100 shown in FIG. 21 in the initialization phase P1. As shown in FIG. 23A, in the initialization phase P1, since the voltage of the first reset signal is at a low level, the fourth transistor T4 is controlled to be turned on, and the voltage of the anode of the light-emitting device 40 is transmitted to the third node N3 through the fourth transistor T4. The voltage of the first scanning signal is at the low level, the sixth transistor T6 is turned on, and the voltage of the third node N3 is transmitted to the first node N1 through the sixth transistor T6, so as to reset the first node N1.

The first sub-circuit 51 and the third sub-circuit 31 are in an off state in the initialization phase P1. In this case, as shown in FIG. 23A, the third transistor T3 and the fifth transistor T5 are turned off.

In the data writing phase P2, the voltage of the first scanning signal and the voltage of the second scanning signal are at low levels; the voltage of the control signal is at a high level; and the voltage of the first enable signal is at a high level.

Figure 23B:
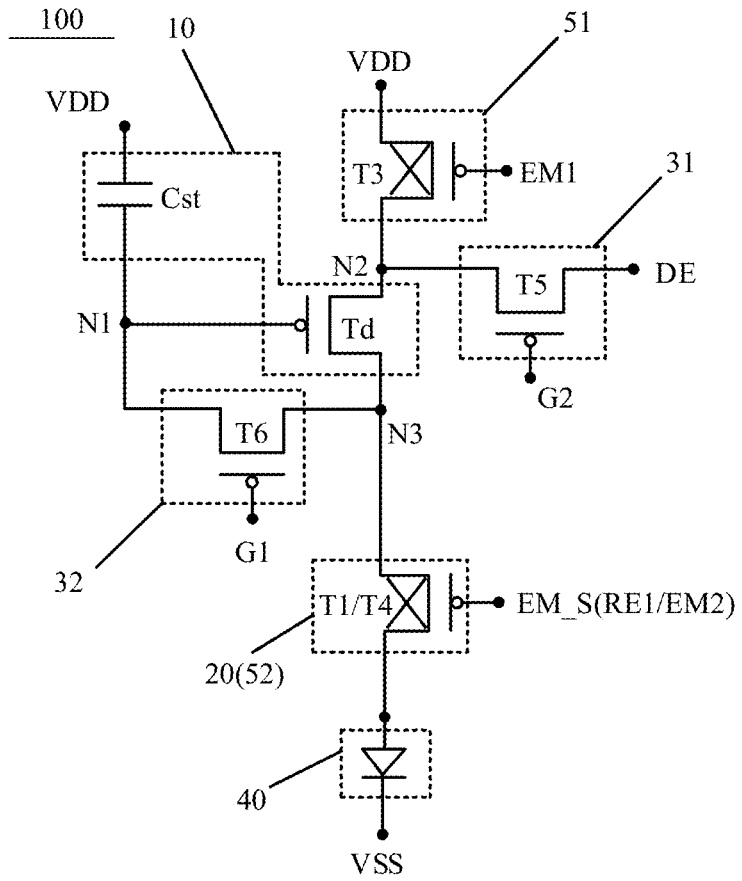
FIG. 23B is a schematic diagram of the pixel circuit shown in FIG. 21 in a data writing phase.

FIG. 23B is an equivalent circuit diagram of the pixel circuit 100 shown in FIG. 21 in the data writing phase P2. As shown in FIG. 23B, in the data writing phase P2, since the voltage of the control signal is at the high level, the fourth transistor T4 is turned off. The voltage of the second scanning signal is at a low level, the fifth transistor T5 is controlled to be turned on, and the data signal from the data terminal DE is transmitted to the second node N2 through the fifth transistor T5. Same as the initialization phase P1, the voltage of the first scanning signal is still at the low level in the data writing phase P2, the sixth transistor T6 remains turned on, and the second electrode and the gate of the driving transistor Td are short-circuited to form a diode structure. The data signal at the second node N2 is transmitted to the first node N1 through the driving transistor Td and the sixth transistor T6. When a difference between the voltage of the first node N1 and a voltage of the second node N2 is reduced to the threshold voltage Vth of the driving transistor Td, the driving transistor Td is turned off.

In the light-emitting phase P3, the voltage of the first enable signal is at a low level; the voltage of the second enable signal is at a low level; and the first scanning signal and the second scanning signal are at high levels.

Figure 23C:
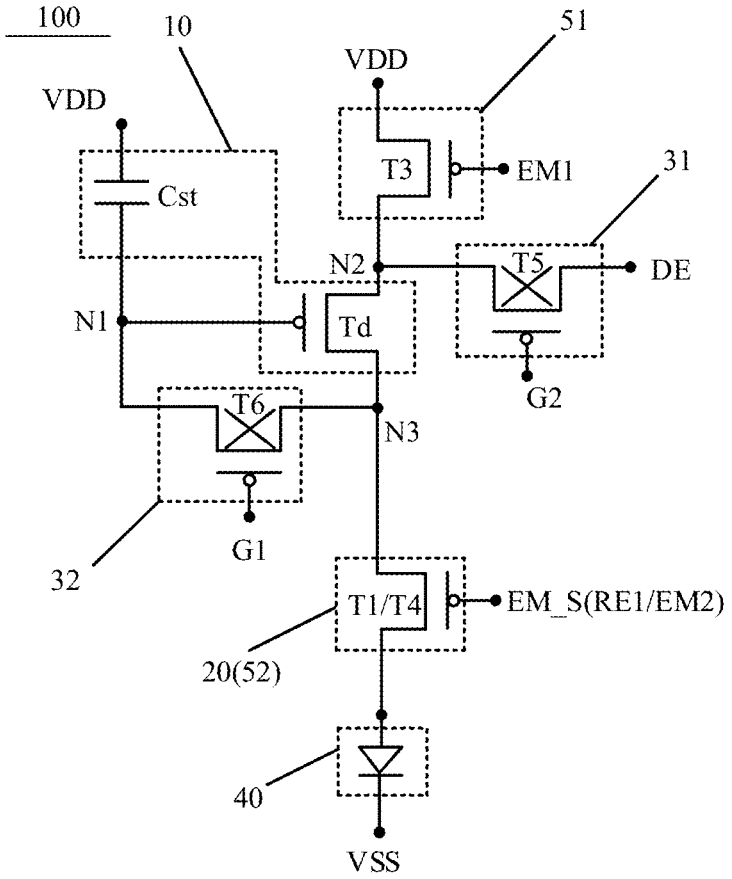
FIG. 23C is a schematic diagram of the pixel circuit shown in FIG. 21 in a light-emitting phase.

FIG. 23C is an equivalent circuit diagram of the pixel circuit 100 shown in FIG. 21 in the light-emitting phase P3. As shown in FIG. 23C, in the light-emitting phase P3, since the voltage of the first scanning signal is at a high level, the sixth transistor T6 is turned off. Since the voltage of the second scanning signal is at a high level, the fifth transistor T5 is turned off. Since the voltage of the first enable signal and the voltage of the second enable signal are at low levels, the third transistor T3 and the fourth transistor T4 are turned on. The voltage signal of the first voltage terminal VDD is transmitted to the second node N2 through the third transistor T3. The driving transistor Td generates a current under control of the voltage of the first node N1 and the voltage signal of the first voltage terminal VDD. The current is transmitted to the light-emitting device 40 through the fourth transistor T4, so that the light-emitting device 40 emits light.

The first reset sub-circuit 20 is used as second sub-circuit 52, which may reduce at least one transistor, thereby simplifying the structure of the pixel circuit 100.

Figure 24:
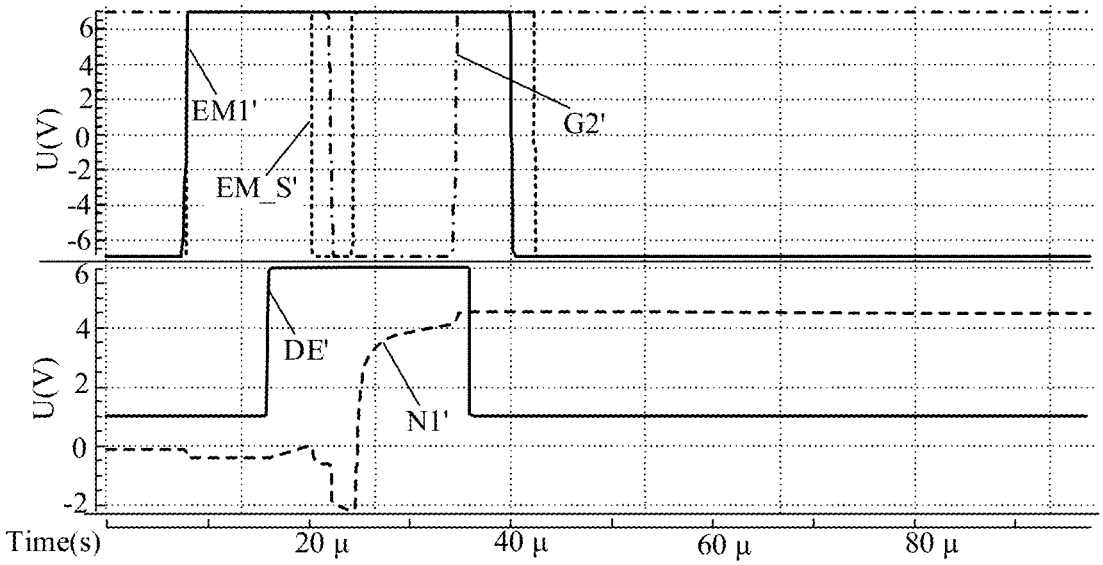
FIG. 24 is a diagram showing a simulation result of signals of another pixel circuit provided in embodiments of the present disclosure.

FIG. 24 shows a simulation result of signals in the driving process of the pixel circuit 100 in one image frame in the fifth possible implementation manner. It can be seen from FIG. 24 that normal initialization and writing of the data signal can be performed on the first node N1.

A sixth possible implementation manner is as follows.

Figure 25:
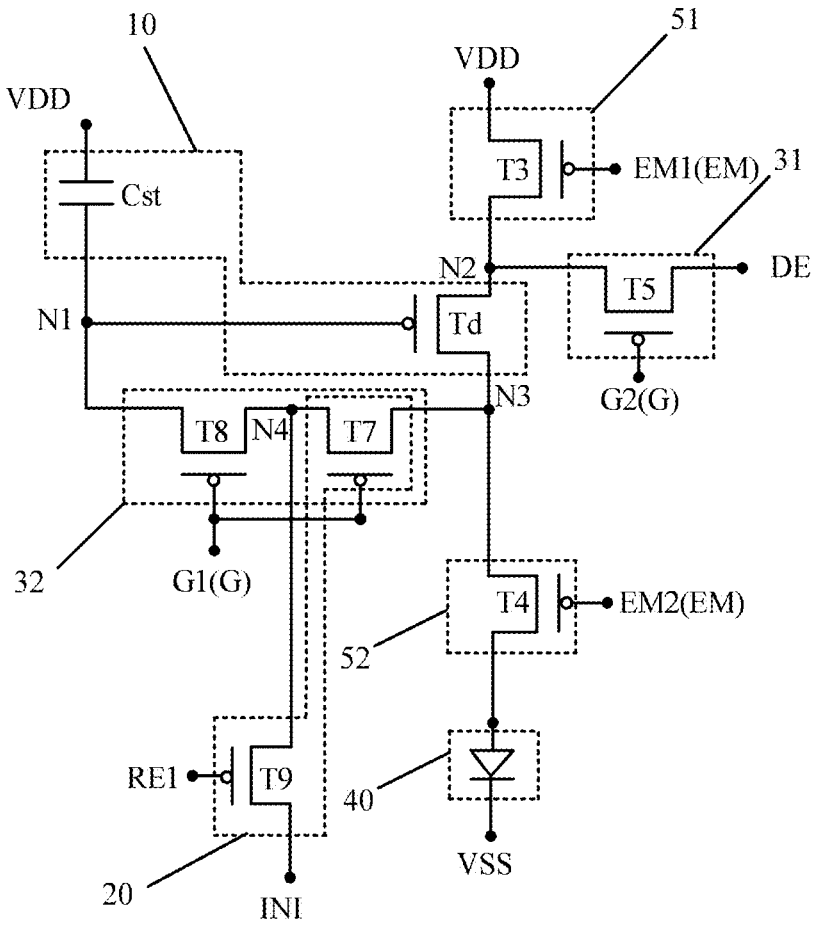
FIG. 25 is a diagram showing a structure of yet another pixel circuit provided in embodiments of the present disclosure.

As shown in FIG. 25, the fourth sub-circuit 32 includes a seventh transistor T7 and an eighth transistor T8.

A gate of the seventh transistor T7 is connected to the first scanning terminal G1, a first electrode of the seventh transistor T7 is connected to the third node N3, and a second electrode of the seventh transistor T7 is connected to the fourth node N4. A gate of the eighth transistor T8 is connected to the first scanning terminal G1, a first electrode of the eighth transistor T8 is connected to the fourth node N4, and a second electrode of the eighth transistor T8 is connected to the first node N1.

On this basis, as shown in FIG. 25, the first reset sub-circuit 20 includes a ninth transistor T9 and the seventh transistor T7.

A gate of the ninth transistor T9 is connected to the first reset signal terminal RE1, a first electrode of the ninth transistor T9 is connected to the initialization signal terminal INI, and a second electrode of the ninth transistor T9 is connected to the fourth node N4.

For structures of the first sub-circuit 51, the second sub-circuit 52, and the third sub-circuit 31, reference can be made to structures of the first sub-circuit 51, the second sub-circuit 52, and the third sub-circuit 31 in the first possible implementation manner, which will not be repeated here.

The first scanning terminal G1 and the second scanning terminal G2 are connected to a same scanning terminal G. The first enable signal terminal EM1 and the second enable signal terminal EM2 are connected to a same enable signal terminal EM.

Figure 26:
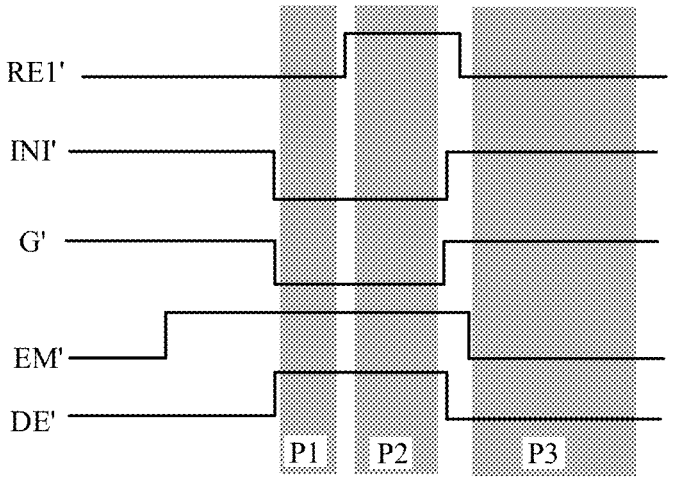
FIG. 26 is a timing diagram of the pixel circuit shown in FIG. 25.

A timing diagram corresponding to the pixel circuit 100 in FIG. 25 is shown in FIG. 26. The first reset signal terminal RE1 transmits the first reset signal RE1', the scanning terminal G transmits a scanning signal G', the enable signal terminal EM transmits an enable signal EM', and the initialization signal terminal INI transmits the initialization signal INI'.

In the initialization phase P1, the voltage of the first reset signal and a voltage of the scanning signal are at low levels, and a voltage of the enable signal is at a high level.

Figure 27A:
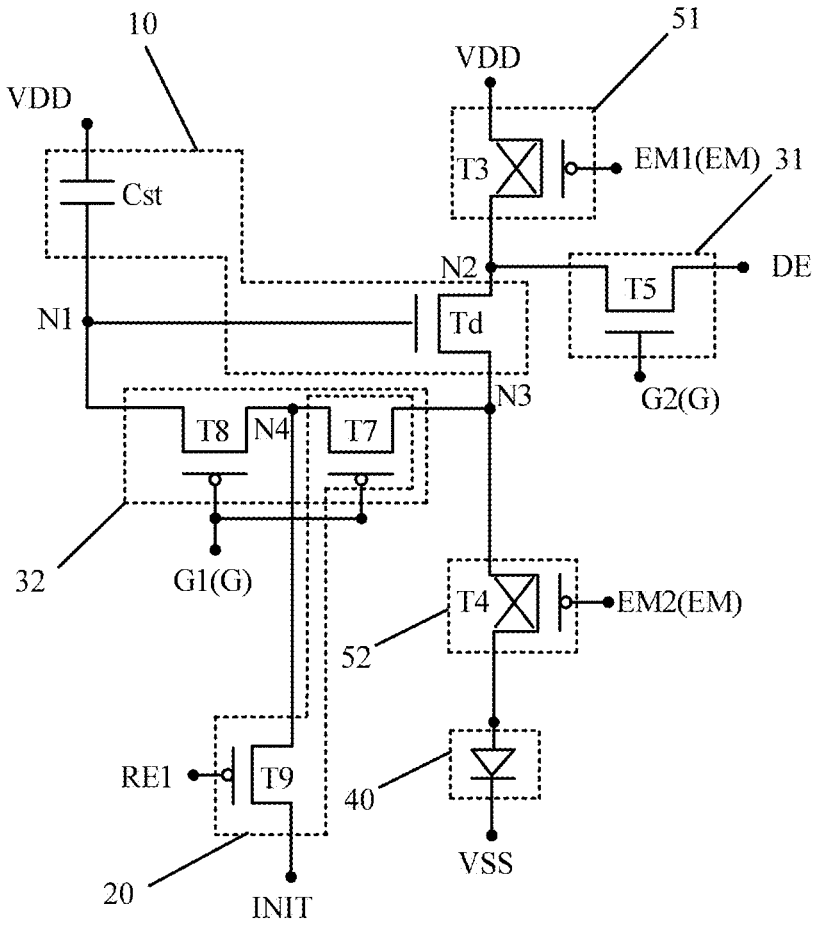
FIG. 27A is a schematic diagram of the pixel circuit shown in FIG. 25 in an initialization phase.

FIG. 27A is an equivalent circuit diagram of the pixel circuit 100 shown in FIG. 25 in the initialization phase P1. As shown in FIG. 27A, in the initialization phase P1, since the voltage of the first reset signal is at a low level, the ninth transistor T9 is controlled to be turned on, and the initialization signal transmitted by the initialization signal terminal INI is transmitted to the fourth node N4 through the ninth transistor T9. For example, in the initialization phase P1, the voltage of the initialization signal is at a first level, which is, for example, −2.5 V. Since the voltage of the scanning signal is at a low level, the seventh transistor T7 and the eighth transistor T8 are turned on, and the initialization signal which is at the first level is transmitted to the first node N1 and the third node N3 through the seventh transistor T7 and the eighth transistor T8, respectively.

In the initialization phase P1, since the voltage of the enable signal is at the high level, the third transistor T3 and the fourth transistor T4 are turned off.

For example, in the initialization phase P1, the data terminal DE may also transmit the data signal for precharging, which is conducive to writing the data signal.

In the data writing phase P2, the voltage of the scanning signal is at a low level, and the voltage of the first reset signal and the voltage of the enable signal are at high levels.

Figure 27B:
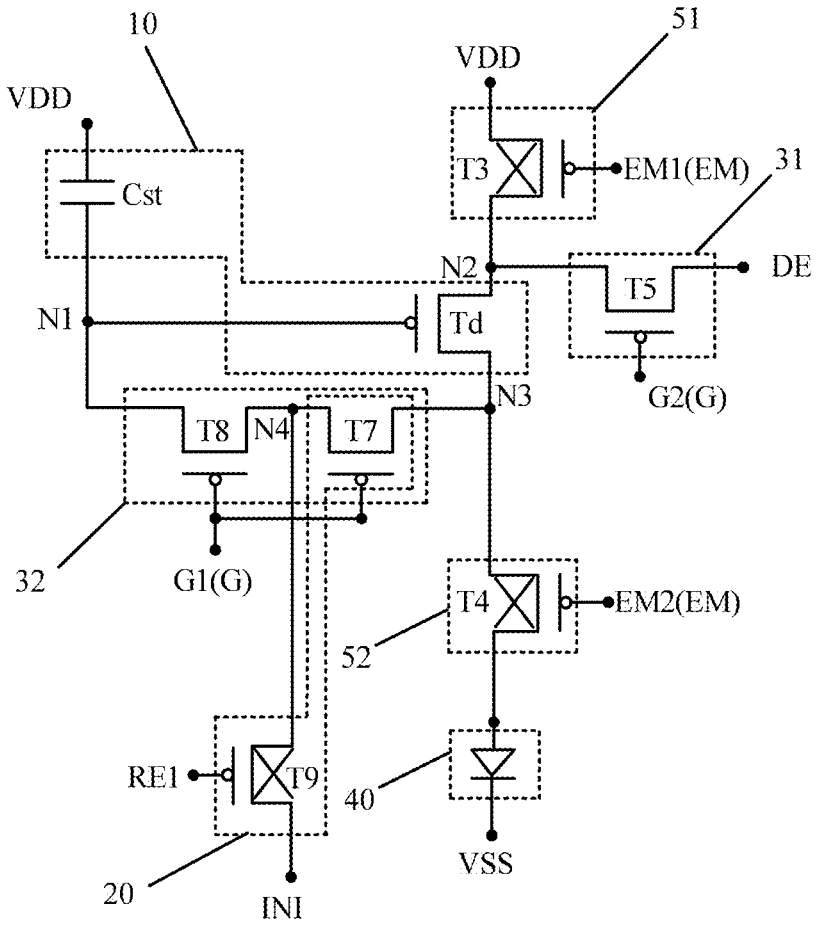
FIG. 27B is a schematic diagram of the pixel circuit shown in FIG. 25 in a data writing phase.

FIG. 27B is an equivalent circuit diagram of the pixel circuit 100 shown in FIG. 25 in the data writing phase P2. As shown in FIG. 27B, in the data writing phase P2, since the voltage of the first reset signal is at a high level, the ninth transistor T9 is turned off. The voltage of the scanning signal is at the low level, the fifth transistor T5 is turned on, and the data signal from the data terminal DE is transmitted to the second node N2 through the fifth transistor T5. The seventh transistor T7 and the eighth transistor T8 are turned on, so that the second electrode and the gate of the driving transistor Td are short-circuited to form a diode structure, and the data signal at the second node N2 is transmitted to the first node N1 through the driving transistor Td, the seventh transistor T7 and the eighth transistor T8. When a difference between the voltage of the first node N1 and a voltage of the second node N2 is reduced to the threshold voltage Vth of the driving transistor Td, the driving transistor Td is turned off.

In the light-emitting phase P3, the voltage of the first reset signal and the voltage of the enable signal are at low levels, and the voltage of the scanning signal is at a high level.

Figure 27C:
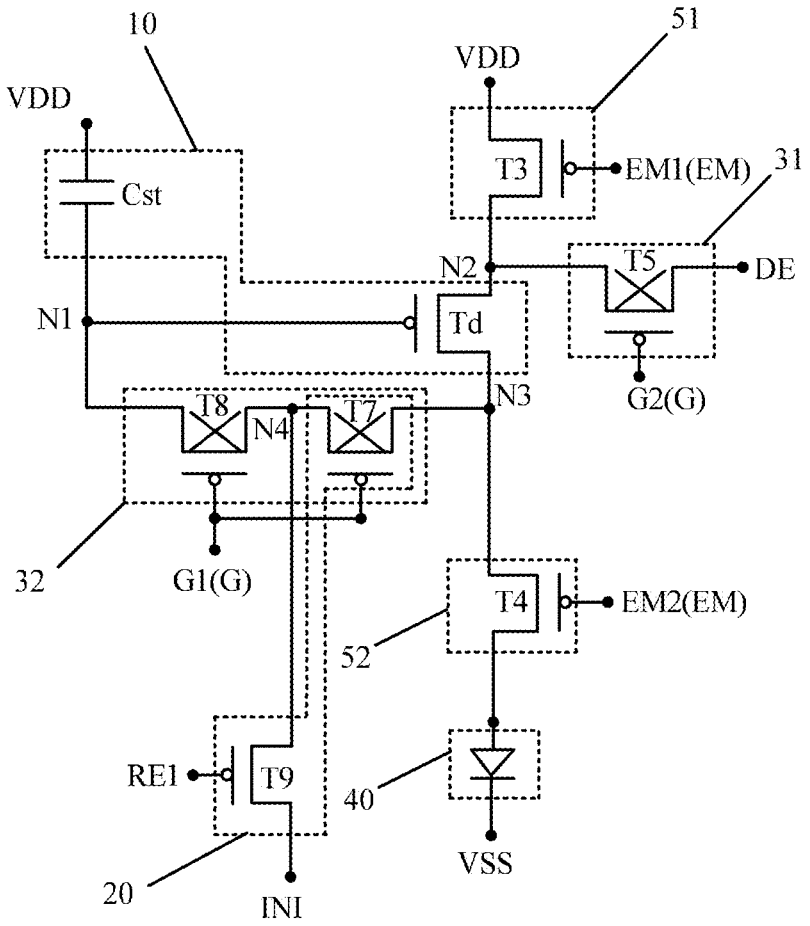
FIG. 27C is a schematic diagram of the pixel circuit shown in FIG. 25 in a light-emitting phase.

FIG. 27C is an equivalent circuit diagram of the pixel circuit 100 shown in FIG. 25 in the light-emitting phase P3. As shown in FIG. 27C, in the light-emitting phase P3, since the voltage of the first reset signal is at a low level, the ninth transistor T9 is controlled to be turned on. The voltage of the initialization signal is at a second level, and the initialization signal which is at the second level is transmitted to the fourth node N4 through the ninth transistor T9. For example, in the light-emitting phase P3, the second level is 4.5 V.

Since the voltage of the scanning signal is at the high level, the fifth transistor T5, the seventh transistor T7 and the eighth transistor T8 are turned off.

Since the voltage of the enable signal is at a low level, the third transistor T3 and the fourth transistor T4 are turned on. The voltage signal of the first voltage terminal VDD is transmitted to the second node N2 through the third transistor T3. The driving transistor Td generates a current under control of the voltage on the first node N1 and the voltage signal of the first voltage terminal VDD. The current is transmitted to the light-emitting device 40 through the fourth transistor T4, so that the light-emitting device 40 emits light.

In the pixel circuit, in the light-emitting phase P3, the initialization signal at the second level is transmitted to the fourth node N4 through the ninth transistor T9, and the second level is at a high level, so that a voltage difference between the first node N1 and the fourth node N4 is reduced. As a result, a leakage current from the first node N1 to the fourth node N4 is reduced, and the voltage of the first node N1 in the image frame may be better maintained, which further reduces the probability of the flicker phenomenon.

Figure 28:
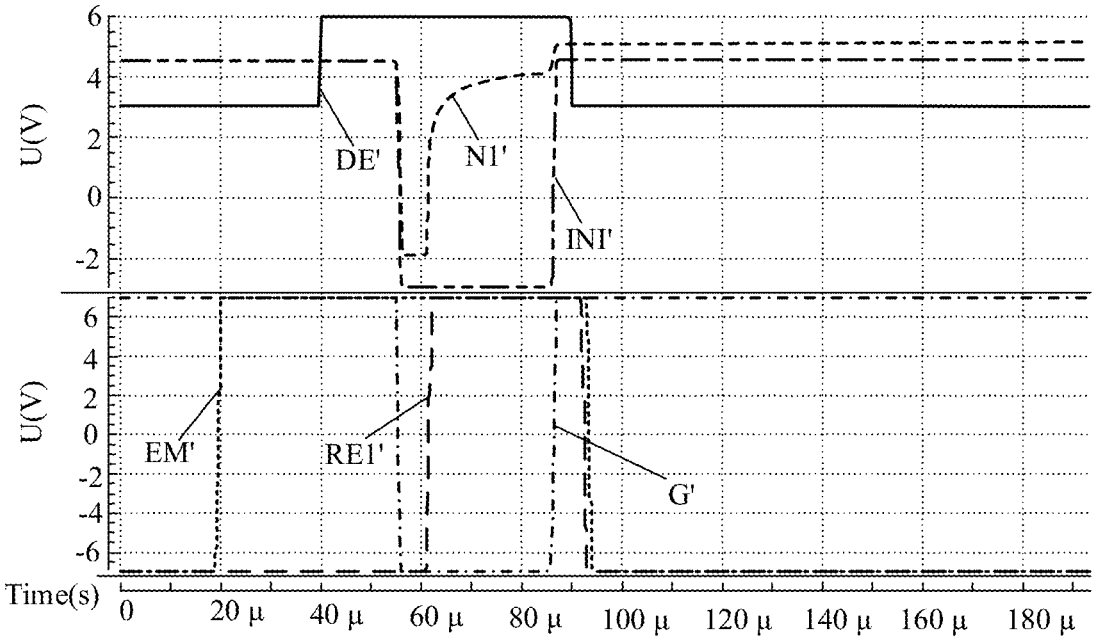
FIG. 28 is a diagram showing a simulation result of signals of yet another pixel circuit provided in embodiments of the present disclosure.

FIG. 28 shows a simulation result of signals in the driving process of the pixel circuit 100 in one image frame in the sixth possible implementation manner. It can be seen from FIG. 28 that normal initialization and writing of the data signal can be performed on the first node N1.

Figure 29:
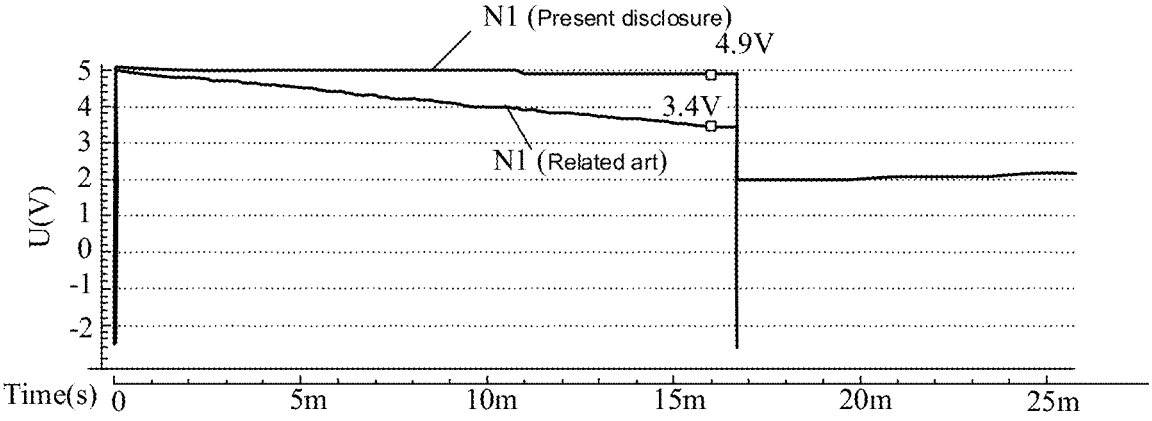
FIG. 29 is a diagram showing a simulation result of voltages of a gate of a driving transistor in another pixel circuit provided in embodiments of the present disclosure and a gate of a driving transistor in a driving circuit provided in the related art.

FIG. 29 is a diagram showing a simulation result, in one image frame, of the voltages of the gate of the driving transistor Td in the pixel circuit 100 provided in the sixth possible implementation manner of the present disclosure and the gate of the driving transistor Td' the driving circuit 100' provided in the related art. In the image frame, the voltage of the gate of the driving transistor Td' in the driving circuit 100' provided in the related art changes from 5 V to 3.4 V, and the change amount ΔV of the voltage thereof reaches 1.6 V. The voltage of the gate of the driving transistor Td in the pixel circuit 100 provided in the sixth possible implementation manner of the present disclosure changes from 5 V to 4.9 V, and the change amount ΔV of the voltage thereof is 0.1 V. The pixel circuit 100 provided in the embodiments of the present disclosure can effectively maintain the voltage of the gate of the driving transistor Td, which is conducive to improving the flicker phenomenon, and thus the pixel circuit may be used in the display panel with an ultra-low frequency (e.g., 1 Hz).

A seventh possible implementation manner is as follows.

Figure 30A:
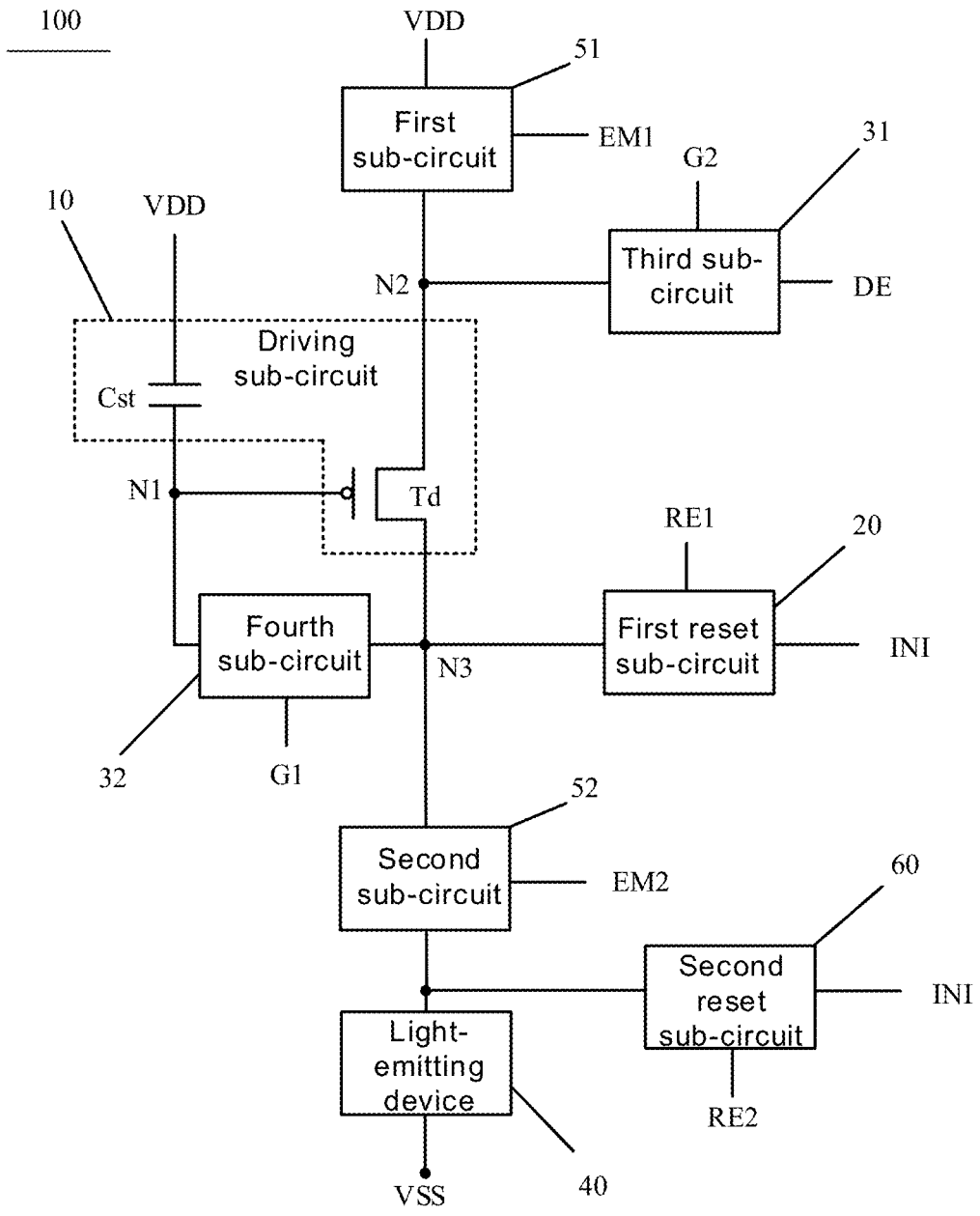
FIG. 30A is a structural diagram of yet another pixel circuit provided in embodiments of the present disclosure.

On the basis of the first possible implementation manner, the second possible implementation manner, the third possible implementation manner, and the sixth possible implementation manner, as shown in FIG. 30A, the pixel circuit 100 further includes a second reset sub-circuit 60, and the second reset sub-circuit 60 is connected to the anode of the light-emitting device 40, a second reset signal terminal RE2 and the initialization signal terminal INI. The second reset signal terminal RE2 is configured to receive a second reset signal and transmit the second reset signal to the second reset sub-circuit 60. The initialization signal terminal INI is further configured to transmit the initialization signal to the second reset sub-circuit 60.

The second reset sub-circuit 60 is configured to, in the initialization phase P1 or the data writing phase P2, transmit the initialization signal from the initialization signal terminal INI to the light-emitting device under control of the second reset signal received at the second reset signal terminal RE2, so as to reset the anode of the light-emitting device 40.

The second reset sub-circuit 60 may reset the anode of the light-emitting device 40 to avoid effect of the residual voltage of the anode of the light-emitting device 40 on a next image frame when an image frame ends.

In some embodiments, the second reset signal terminal RE2 and the first reset signal terminal RE1 are connected to a same reset signal terminal. In this way, the structure of the pixel circuit 100 may be simplified.

It will be noted that, in the case where the first reset signal terminal RE1 and the second reset signal terminal RE2 are connected to the same reset signal terminal, the first reset signal and the second reset signal are a same reset signal. In this case, the second reset sub-circuit 60 is configured to, in the initialization phase P1, transmit the initialization signal from the initialization signal terminal INI to the anode of the light-emitting device 40, so as to reset the anode of the light-emitting device 40.

Figure 30B:
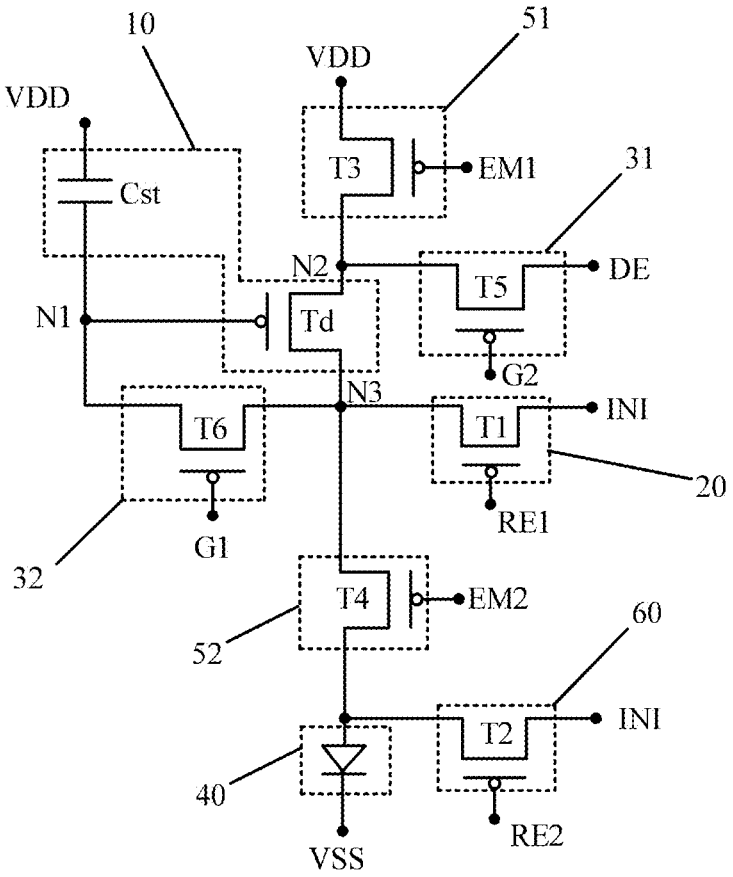
FIG. 30B is a diagram showing a structure of the pixel circuit shown in FIG. 30A.

In some examples, as shown in FIG. 30B, the second reset sub-circuit 60 includes a second transistor T2. A gate of the second transistor T2 is connected to the second reset signal terminal RE2, a first electrode of the second transistor T2 is connected to the initialization signal terminal INI, and a second electrode of the second transistor T2 is connected to the anode of the light-emitting device 40.

In some other examples, the second reset sub-circuit 60 includes a plurality of second transistors T2 connected in parallel or in series. In a case where the second reset sub-circuit 60 includes the plurality of second transistors T2 connected in parallel, gates of the plurality of second transistors T2 are connected to the second reset signal terminal RE2, first electrodes of the plurality of second transistors T2 are connected to the initialization signal terminal INI, and second electrodes of the plurality of second transistors T2 are connected to the anode of the light-emitting device 40. In a case where the second reset sub-circuit 60 includes the plurality of second transistors T2 connected in series, the plurality of second transistors T2 are connected in sequence. A second electrode of a first second transistor T2 is connected to a first electrode of a second transistor T2, and so on. The gates of the plurality of second transistors T2 are connected to the second reset signal terminal RE2, a first electrode of the first second transistor T2 in the plurality of second transistors T2 is connected to the initialization signal terminal INI, and a second electrode of a last second transistor T2 in the plurality of second transistors T2 is connected to the anode of the light-emitting device 40. The above descriptions are merely examples of the second reset sub-circuit 60, and other structures with the same function as the second reset sub-circuit 60 will not be repeated here, but shall all be included in the protection scope of the present disclosure.

The foregoing descriptions are merely specific implementations of the present disclosure, but the protection scope of the present disclosure is not limited thereto. Any changes or replacements that a person skilled in the art could conceive of within the technical scope of the present disclosure shall be included in the protection scope of the present disclosure. Therefore, the protection scope of the present disclosure shall be subject to the protection scope of the claims.

What is claimed is:

1. A pixel circuit, comprising:

a driving sub-circuit, the driving sub-circuit including:

a driving transistor, a gate of the driving transistor being connected to a first node, a first electrode of the driving transistor being connected to a second node, and a second electrode of the driving transistor being connected to a third node; and a storage capacitor, including a first storage electrode and a second storage electrode, the first storage electrode being connected to the first node, and the second storage electrode being connected to a first voltage terminal;

a first reset sub-circuit connected to at least the third node, a first reset signal terminal and an initialization signal terminal; the first reset sub-circuit being configured to, in an initialization phase, transmit an initialization signal from the initialization signal terminal to the third node under control of at least a first reset signal received at the first reset signal terminal;

a writing sub-circuit connected to a first scanning terminal, a second scanning terminal, a data terminal, the first node, the second node, and the third node; the writing sub-circuit being configured to: in the initialization phase, transmit the initialization signal at the third node to the first node under control of a first scanning signal received at the first scanning terminal, so as to reset the first node; and in a data writing phase, write a data signal received at the data terminal to the first node and perform threshold voltage compensation on the driving transistor under the control of the first scanning signal received at the first scanning terminal and control of a second scanning signal received at the second scanning terminal;

a light-emitting device including an anode and a cathode, the cathode being connected to a second voltage terminal; and a light-emitting control sub-circuit connected to the second node, the third node, the first voltage terminal, a first enable signal terminal, a second enable signal terminal, and the anode of the light-emitting device; the light-emitting control sub-circuit being configured to: in a light-emitting phase, under control of a first enable signal received at the first enable signal terminal and control of a second enable signal received at the second enable signal terminal, transmit a voltage signal of the first voltage terminal to the second node, and transmit a current output by the driving transistor to the light-emitting device to make the light-emitting device emit light.

2. The pixel circuit according to claim 1, further comprising:

a second reset sub-circuit connected to the anode of the light-emitting device, a second reset signal terminal, and the initialization signal terminal, and the second reset sub-circuit being configured to, in the initialization phase or the data writing phase, transmit the initialization signal from the initialization signal terminal to the anode of the light-emitting device under control of a second reset signal received at the second reset signal terminal, so as to reset the anode.

3. The pixel circuit according to claim 2, wherein the first reset signal terminal and the second reset signal terminal are connected to a same reset signal terminal.

4. The pixel circuit according to claim 2, wherein the second reset sub-circuit includes a second transistor, a gate of the second transistor is connected to the second reset signal terminal, a first electrode of the second transistor is connected to the initialization signal terminal, and a second electrode of the second transistor is connected to the anode of the light-emitting device.

5. The pixel circuit according to claim 1, wherein the light-emitting control sub-circuit includes a first sub-circuit and a second sub-circuit;

the first sub-circuit is connected to the second node, the first voltage terminal, and the first enable signal terminal, and the first sub-circuit is configured to, in the light-emitting phase, transmit the voltage signal of the first voltage terminal to the second node under the control of the first enable signal received at the first enable signal terminal; and the second sub-circuit is connected to the third node, the second enable signal terminal and the anode of the light-emitting device, and the second sub-circuit is configured to, in the light-emitting phase, transmit the current output by the driving transistor to the light-emitting device under the control of the second enable signal received at the second enable signal terminal.

6. The pixel circuit according to claim 5, wherein the first enable signal terminal and the second enable signal terminal are connected to a same enable signal terminal; or the initialization signal terminal is connected to the anode of the light-emitting device.

7. The pixel circuit according to claim 5, wherein the first reset sub-circuit is used as the second sub-circuit, the initialization signal terminal is connected to the anode of the light-emitting device, and the first reset signal terminal and the second enable signal terminal are connected to a same signal terminal; and the signal terminal is configured to transmit the first reset signal in the initialization phase, and transmit the second enable signal in the light-emitting phase.

8. The pixel circuit according to claim 5, wherein the first sub-circuit includes a third transistor, a gate of the third transistor is connected to the first enable signal terminal, a first electrode of the third transistor is connected to the first voltage terminal, and a second electrode of the third transistor is connected to the second node; and the second sub-circuit includes a fourth transistor, a gate of the fourth transistor is connected to the second enable signal terminal, a first electrode of the fourth transistor is connected to the third node, and a second electrode of the fourth transistor is connected to the anode of the light-emitting device.

9. The pixel circuit according to claim 1, wherein the first scanning terminal and the second scanning terminal are connected to a same scanning terminal.

10. The pixel circuit according to claim 9, wherein the first reset sub-circuit includes a first transistor, a gate of the first transistor is connected to the first reset signal terminal, a first electrode of the first transistor is connected to the initialization signal terminal, and a second electrode of the first transistor is connected to the third node.

11. The pixel circuit according to claim 1, wherein the writing sub-circuit includes a third sub-circuit and a fourth sub-circuit;

the third sub-circuit is connected to the second scanning terminal, the data terminal, and the second node, and the third sub-circuit is configured to be turned on at least in the data writing phase under the control of the second scanning signal received at the second scanning terminal, and transmit the data signal received at the data terminal to the second node; and the fourth sub-circuit is connected to the first scanning terminal, the first node, and the third node, and the fourth sub-circuit is configured to be turned on in the initialization phase and the data writing phase under the control of the first scanning signal received at the first scanning terminal, transmit the initialization signal at the third node to the first node in the initialization phase, and write the data signal at the second node to the first node and perform threshold voltage compensation on the driving transistor in the data writing phase.

12. The pixel circuit according to claim 11, wherein the third sub-circuit includes a fifth transistor, a gate of the fifth transistor is connected to the second scanning terminal, a first electrode of the fifth transistor is connected to the data terminal, and a second electrode of the fifth transistor is connected to the second node.

13. The pixel circuit according to claim 12, wherein the fourth sub-circuit includes a sixth transistor, a gate of the sixth transistor is connected to the first scanning terminal, a first electrode of the sixth transistor is connected to the third node, and a second electrode of the sixth transistor is connected to the first node.

14. The pixel circuit according to claim 12, wherein the fourth sub-circuit includes a seventh transistor and an eighth transistor;

a gate of the seventh transistor is connected to the first scanning terminal, a first electrode of the seventh transistor is connected to the third node, and a second electrode of the seventh transistor is connected to a fourth node; and a gate of the eighth transistor is connected to the first scanning terminal, a first electrode of the eighth transistor is connected to the fourth node, and a second electrode of the eighth transistor is connected to the first node.

15. The pixel circuit according to claim 14, wherein the first reset sub-circuit includes a ninth transistor and the seventh transistor; and a gate of the ninth transistor is connected to the first reset signal terminal, a first electrode of the ninth transistor is connected to the initialization signal terminal, and a second electrode of the ninth transistor is connected to the fourth node.

16. A display panel, comprising at least one pixel circuit according to claim 1.

17. The display panel according to claim 16, wherein the display panel has a plurality of sub-pixel regions arranged in an array, and each sub-pixel region is provided with the pixel circuit;

the display panel further comprises a plurality of scanning lines, and first scanning terminals and second scanning terminals to which pixel circuits located in a same row are connected are connected to a scanning line; or the display panel further comprises a plurality of first scanning lines and a plurality of second scanning lines, and first scanning terminals and second scanning terminals to which pixel circuits located in a same row are connected are respectively connected to a first scanning line and a second scanning line.

18. The display panel according to claim 17, wherein the first scanning terminals and the second scanning terminals to which the pixel circuits located in the same row are connected are connected to the scanning line, and first reset signal terminals to which pixel circuits located in an nth row are connected are connected to a scanning line that is connected to pixel circuits located in an (n−1)th row.

19. A driving method of the pixel circuit according to claim 1, the driving method comprising:

in an initialization phase of an image frame, inputting the first reset signal to the first reset signal terminal, so that the first reset sub-circuit transmits the initialization signal from the initialization signal terminal to the third node; and inputting the first scanning signal to the first scanning terminal, so that the writing sub-circuit transmits the initialization signal at the third node to the first node to reset the first node;

in a data writing phase of the image frame, inputting the first scanning signal to the first scanning terminal, inputting the second scanning signal to the second scanning terminal, and inputting the data signal to the data terminal, so that the writing sub-circuit writes the data signal received at the data terminal into the first node, and performs the threshold voltage compensation on the driving transistor; and in a light-emitting phase of the image frame, inputting the first enable signal to the first enable signal terminal, and inputting the second enable signal to the second enable signal terminal, so that the light-emitting control sub-circuit transmits the voltage signal of the first voltage terminal to the second node, and transmits the current output by the driving transistor to the light-emitting device to make the light-emitting device emit light.

20. The driving method according to claim 19, further comprising:

in the initialization phase of the image frame, inputting the data signal to the data terminal.

* * * * *